US008366842B2

(12) United States Patent
Sawada et al.

(10) Patent No.: US 8,366,842 B2
(45) Date of Patent: Feb. 5, 2013

(54) METHOD AND APPARATUS FOR MANUFACTURING ALUMINUM ALLOY STRIP FOR LITHOGRAPHIC PRINTING PLATES

(75) Inventors: Hirokazu Sawada, Shizuoka (JP); Akio Uesugi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/241,423

(22) Filed: Sep. 23, 2011

(65) Prior Publication Data

US 2012/0014834 A1 Jan. 19, 2012

Related U.S. Application Data

(62) Division of application No. 12/138,491, filed on Jun. 13, 2008, now Pat. No. 8,048,364.

(30) Foreign Application Priority Data

Jun. 29, 2007 (JP) ..... 2007-172285

(51) Int. Cl.
*C22C 21/00* (2006.01)

(52) U.S. Cl. ..... 148/551; 75/686

(58) Field of Classification Search ..... 75/686; 148/551; 164/462

See application file for complete search history.

(56) References Cited

U.S. PATENT DOCUMENTS

| | | | | |
|---|---|---|---|---|
| 4,634,656 | A * | 1/1987 | Ohashi et al. | 430/278.1 |
| 5,076,899 | A * | 12/1991 | Sakaki et al. | 430/278.1 |
| 5,176,198 | A | 1/1993 | Frischknecht et al. | |
| 5,762,729 | A * | 6/1998 | Nishikawa et al. | 148/551 |
| 2007/0012573 | A1 | 1/2007 | Sawada et al. | |

FOREIGN PATENT DOCUMENTS

| | | | |
|---|---|---|---|
| JP | 10-052740 | A | 2/1998 |
| JP | 11-047892 | A | 2/1999 |
| JP | 11-254093 | A | 9/1999 |
| JP | 2000-024762 | A | 1/2000 |
| JP | 3549080 | B2 | 4/2004 |
| JP | 2007-021519 | A | 2/2007 |

OTHER PUBLICATIONS

EP Communication, dated Oct. 1, 2008, issued in corresponding EP application No. 08010952.3, 8 pages.

* cited by examiner

*Primary Examiner* — Scott Kastler
(74) *Attorney, Agent, or Firm* — Sughrue Mion, PLLC

(57) ABSTRACT

An apparatus for manufacturing aluminum alloy strip for a lithographic printing plate supports includes a filter, a launder connected to the filter, a liquid level controller connected to the launder, and a melt feed nozzle connected to the liquid level controller. The liquid level controller includes a step to trap settled particles within an aluminum melt which forms the alloy strip. The launder has a length L (m) which satisfies the condition $4 \geqq L \geqq V \times 270 \times 1.2 \times D$, where V is the flow velocity in meters per second of the aluminum melt in the launder and D is the depth in meters of the aluminum melt in the launder.

1 Claim, 4 Drawing Sheets

METHOD AND APPARATUS FOR MANUFACTURING ALUMINUM ALLOY STRIP FOR LITHOGRAPHIC PRINTING PLATES

This application is a divisional of U.S. Application No. 12/138,491, filed Jun. 13, 2008, now U.S. Pat. No. 8,048,364, which claims priority to JP 2007-172285, filed Jun. 29, 2007, each of which is incorporated herein by reference in its entirety.

The entire contents of all documents cited in this specification are incorporated herein by reference.

BACKGROUND OF THE INVENTION

The present invention relates to a method of manufacturing aluminum alloy strip for use in the production of lithographic printing plates. The invention also relates to an apparatus for manufacturing such aluminum alloy strip. The invention further relates to aluminum alloy strip for use in the production of lithographic printing plates which is obtained by such a method.

Methods of manufacturing aluminum alloy strip for lithographic printing plates by a continuous casting process typically include a casting step which involves melting an aluminum starting material, subjecting the resulting aluminum melt to filtration treatment, feeding the filtered melt via a melt feed nozzle to a pair of cooled rolls, and solidifying and concurrently rolling the aluminum melt by means of the pair of cooled rolls so as to form an aluminum alloy strip; a cold rolling step; an intermediate annealing step; a finish cold-rolling step; and a flatness correcting step to give an aluminum alloy strip having a thickness of from 0.1 to 0.5 mm. Because these operations are simple, compared with conventional methods of manufacturing aluminum alloy plate for lithographic printing plates that include a direct-chill casting step, a scalping step, a heat soaking step, a heating step and a hot rolling step, the yield is excellent with little loss, the continuous casting process is less subject to fluctuations in the different steps, and the initial equipment costs and running costs are low. On the other hand, because black streaks and other defects specific to continuous casting processes tend to arise, cast strip thus obtained is often unfit for use in the production of lithographic printing plates and other materials which must have a high surface quality.

When continuous casting is carried out, a titanium and boron-containing aluminum alloy is added to the aluminum melt. The $TiB_2$ particles that arise from the titanium and boron-containing aluminum alloy which has been added to the aluminum melt and melted act as a grain refiner. $TiB_2$ particles are, individually, lamellar particles having a size of 1 to 2 μm and a thickness of 0.1 to 0.5 μm, but they readily form agglomerates. If agglomerates having a particle size of 100 μm or more (referred to herein as "coarse $TiB_2$ particles") are incorporated into the cast strip, when the cast strip is subjected to rolling or annealing or both and finished into a sheet, intermittent black streak-like defects sometimes arise on the surface of the sheet. Such defects are referred to as "black streaks."

For example, the present inventors earlier disclosed, in JP 3549080 B, a method of manufacturing a lithographic printing plate support which includes a step in which an aluminum melt obtained by the addition of a titanium and boron-containing aluminum alloy is filtered using a filtration tank, then is continuous cast and rolled. In this step, the aluminum melt passes successively through a pre-filter chamber within the filtration tank, a filter which blocks the passage both of single particles 10 μm or larger in size composed of compounds of the titanium and boron present in the titanium and boron-containing alloy and of agglomerates having a particle size of 10 μm or more resulting from the agglomeration of a plurality of such single particles, and a post-filter chamber. At the same time, the pre-filter chamber, the filter and the post-filter chamber are heated by a heater. The same patent publication also discloses, as the filter used in the foregoing method, an aggregation of heat-resistant particles having a size of 5 mm or smaller, and a ceramic tube filter obtained by sintering heat-resistant particles having a size of 0.5 to 2.0 mm.

However, it is known that even with the use of such a fine filter medium, when casting is carried out for a long period of time (i.e., when carrying out continuous casting, such as the casting of more than 50 metric tons), black streaks arises.

In this connection, the inventors have also earlier disclosed in JP 11-47892 A, as a way of preventing black streaks, a continuous casting and rolling apparatus which feeds a melt from a melt feed nozzle to a casting and rolling means, where the melt is then cast and rolled to form a cast strip. This apparatus has formed, at the bottom of a launder through which the melt flows to the melt feed nozzle, a recess in which impurities present in the melt are allowed to settle. The recess has a depth which is from two to five times the depth of the launder, and the recess is open for a length in the direction of flow which is from one to ten times the depth of the launder. However, even when such an apparatus is used, during casting for a long period of time (i.e., during continuous casting, such as the casting of more than 50 metric tons), coarse $TiB_2$ particles which have not settled in the recess become incorporated into the cast strip, leading to the undesirable formation of black streaks.

In addition, the inventors have disclosed in JP 11-254093 A, as a way to prevent black streaks by modifying such a recess, a method of manufacturing aluminum strip using a continuous casting and rolling apparatus provided with, at the bottom of the launder for the aluminum melt, a recess that is notched at a front top edge thereof in the direction of flow, and also a method of manufacturing aluminum strip using a continuous casting and rolling apparatus provided with, at the bottom of the launder for the aluminum melt, a recess that is notched at a back top edge thereof in the direction of flow. However, even using this method, when casting is carried out for a long period of time (i.e., during continuous casting, such as the casting of more than 50 metric tons), black streaks cannot be prevented from forming.

The inventors thus further modified the recess and disclosed in JP 2000-24762 A, as a method for preventing black streaks, a continuous casting and rolling apparatus which feeds the melt from a nozzle to a casting and rolling means, and carries out continuous casting and rolling at the casting and rolling means. The apparatus has, in the recess, a stirring means which agitates the melt in the vicinity of the recess, thereby preventing stagnation in the flow of the melt. However, even with the use of such an apparatus, when casting is carried out for an extended period of time (i.e., during continuous casting, such as the casting of more than 50 metric tons), coarse $TiB_2$ particles that have already settled within the recess swirl up again and are carried downstream, leading to the formation of black streaks.

SUMMARY OF THE INVENTION

It is therefore an object of the present invention to provide a method of manufacturing aluminum alloy strip for use in the production of lithographic printing plate supports, which method is able to prevent the formation of black streaks even when casting is carried out for an extended period of time (i.e., even when continuous casting, such as the casting of more than 50 metric tons, is carried out). A further object of the invention is to provide an apparatus for manufacturing such aluminum alloy strip for use in the production of lithographic printing plate supports.

As noted above, the inventors have confirmed that, although using a fine filtering means to block the passage of coarse $TiB_2$ particles is itself desirable for preventing black streaks, the use of a fine filtering means alone is not enough to prevent black streaks when casting is carried out for an extended period of time (i.e., during continuous casting, such as the casting of more than 50 metric tons). Based on this finding, the inventors have conducted further extensive investigations, as a result of which they have discovered the importance of examining the behavior of $TiB_2$ particles downstream from the filtering means.

The inventors have conducted experiments using simulated launders and simulated fluids, from which they have learned the following concerning the behavior of $TiB_2$ particles downstream from the filtering means.

The first finding is that, no matter how fine the filtering means, there will be times where gaps on the order of several hundreds of microns arise depending on the method of installation and the precision of the fit between the filtering means and the launder. In the course of carrying out casting over a long period of time (i.e., during continuous casting, such as the casting of more than 50 metric tons), the possibility that coarse $TiB_2$ particles having a particle size of 100 μm or more will slip through such gaps cannot be entirely eliminated.

Coarse $TiB_2$ particles having a size of 100 μm or more which have slipped through the filtering means settle over time, sinking to the bottom of the launder. However, if the aluminum melt has a high flow velocity or the launder has a short length, coarse $TiB_2$ particles, instead of sinking to the bottom of the launder, will pass through the liquid level controlling means and the melt feed nozzle and become incorporated into the cast strip, resulting in the formation of black streaks.

Single $TiB_2$ particles having a size of less than 100 μm do not cause black streaks. Rather, they function as a grain refiner when the aluminum melt passes through the melt feed nozzle and is continuous cast with cooled rolls. However, the second finding by the inventors is that because $TiB_2$ particles have a specific gravity of about 4.4 g/cm$^2$, which is larger than the specific gravity of about 2.4 g/cm$^2$ for molten aluminum, even $TiB_2$ particles having a size of less than 100 μm gradually settle toward the bottom of the launder in the course of moving downstream, and a portion of those particles collect at the bottom of the launder, the liquid level controlling means and the melt feed nozzle connected to the liquid level controlling means.

In the course of carrying out casting over a long period of time (i.e., during continuous casting, such as the casting of more than 50 metric tons), $TiB_2$ particles less than 100 μm in size which have collected at the bottom of the launder, the liquid level controlling means and the melt feed nozzle connected to the liquid level controlling means eventually agglomerate, becoming coarse $TiB_2$ particles having a size of 100 μm or more. These coarse $TiB_2$ particles are carried off downstream due to, for example, changes in the flow velocity of the aluminum melt, becoming incorporated into the cast strip and causing black streaks to form.

Also, when coarse $TiB_2$ particles having a size of 100 μm or more that have slipped through the filtering means reach the launder, the liquid level controlling means and the melt feed nozzle connected to the liquid level controlling means and settle to the bottom of these, the coarse $TiB_2$ particles and even coarser particles resulting from agglomeration about the coarse $TiB_2$ particles as nuclei are carried off downstream due to, e.g., changes in the flow velocity of the aluminum melt, becoming incorporated into the cast strip and thus giving rise to black streaks.

Based on the above findings, the inventors have conducted continuous casting tests using real aluminum melts, as a result of which they have discovered that, with the subsequently described inventive method of manufacturing aluminum alloy strip for lithographic printing plates, it is possible to prevent the formation of black streaks by coarse $TiB_2$ particles having a size of 100 μm or more which are carried off downstream and become incorporated into the cast strip.

That is, with the inventive method of manufacturing aluminum alloy strip for lithographic printing plates described below, even when the circumstances indicated above as the first and second findings concerning the behavior of $TiB_2$ particles downstream from the filtration device have arisen, it is possible to prevent the formation of black streaks by coarse $TiB_2$ particles that are carried off downstream and become incorporated into the cast strip.

The present invention provides a method of manufacturing, by a continuous casting process, aluminum alloy strip for use in the production of supports for lithographic printing plates, comprising the step of passing an aluminum melt successively through a filtering means, a launder connected to the filtering means, a liquid level controlling means connected to the launder, and a melt feed nozzle connected to the liquid level controlling means, wherein the aluminum melt is obtained by melting an aluminum starting material, then adding to and melting in the molten aluminum starting material a titanium and boron-containing aluminum alloy, and the time t in seconds required for the aluminum melt to pass through the launder satisfies the following condition (1):

$$t \geqq 270 \times 1.2 \times D \quad (1),$$

where D is the depth in meters of the melt in the launder.

The present invention also provides an apparatus for manufacturing aluminum alloy strip for lithographic printing plate supports using the method described above, comprising:

filtering means, a launder connected to the filtering means, a liquid level controlling means connected to the launder, and a melt feed nozzle connected to the liquid level controlling means, wherein the launder has a length L (m) which satisfies the following condition (2):

$$4 \geqq L \geqq V \times 270 \times 1.2 \times D \quad (2),$$

where V is the flow velocity in meters per second of the aluminum melt in the launder and D is the depth in meters of the aluminum melt in the launder.

In the apparatus described above, it is preferred that the liquid level controlling means has, at one or more place therein, means for trapping settled particles present in the aluminum melt.

It is also preferred that the melt feed nozzle has, at one or more place therein, means for trapping settled particles present in the aluminum melt.

The present invention also provides aluminum alloy strip for use in the production of supports for lithographic printing plates, which strip is obtained by the method described above.

In the inventive method of manufacturing aluminum alloy strip for lithographic printing plates, coarse $TiB_2$ particles having a size of 100 μm or more that have slipped through the filtering means settle to the bottom of the launder connected to the filtering means when casting is carried out for an extended period of time (i.e., during continuous casting, such as the casting of more than 50 metric tons). As a result, the coarse $TiB_2$ particles do not reach the liquid level controlling means and the melt feed nozzle, making it possible to prevent the coarse $TiB_2$ particles from being incorporated into the cast strip and forming black streaks. Moreover, because the launder has a length L of 4 m or less, there is no risk that the aluminum melt will undergo a decrease in temperature as it passes through the launder and a portion of the melt will begin to solidify.

Also, in the inventive method of manufacturing aluminum alloy strip for lithographic printing plates, by providing a means for trapping coarse $TiB_2$ particles present in the aluminum melt at one or more place within the liquid level controlling means, coarse $TiB_2$ particles 100 μm or more is size that have settled to the bottom of the launder and the liquid level controlling means can be prevented from flowing out due to, for example, changes in the flow velocity of the aluminum melt, becoming incorporated into the cast strip, and giving rise to black streaks.

Similarly, by providing a means for trapping coarse $TiB_2$ particles present in the aluminum melt at one or more place within the melt feed nozzle, coarse $TiB_2$ particles having a size of 100 μm or more that have settled within the melt feed nozzle can be prevented from flowing out due to changes in the flow velocity of the aluminum melt, becoming incorporated into the cast strip, and giving rise to black streaks.

BRIEF DESCRIPTION OF THE DIAGRAMS

DETAILED DESCRIPTION OF THE INVENTION

Figure 1:
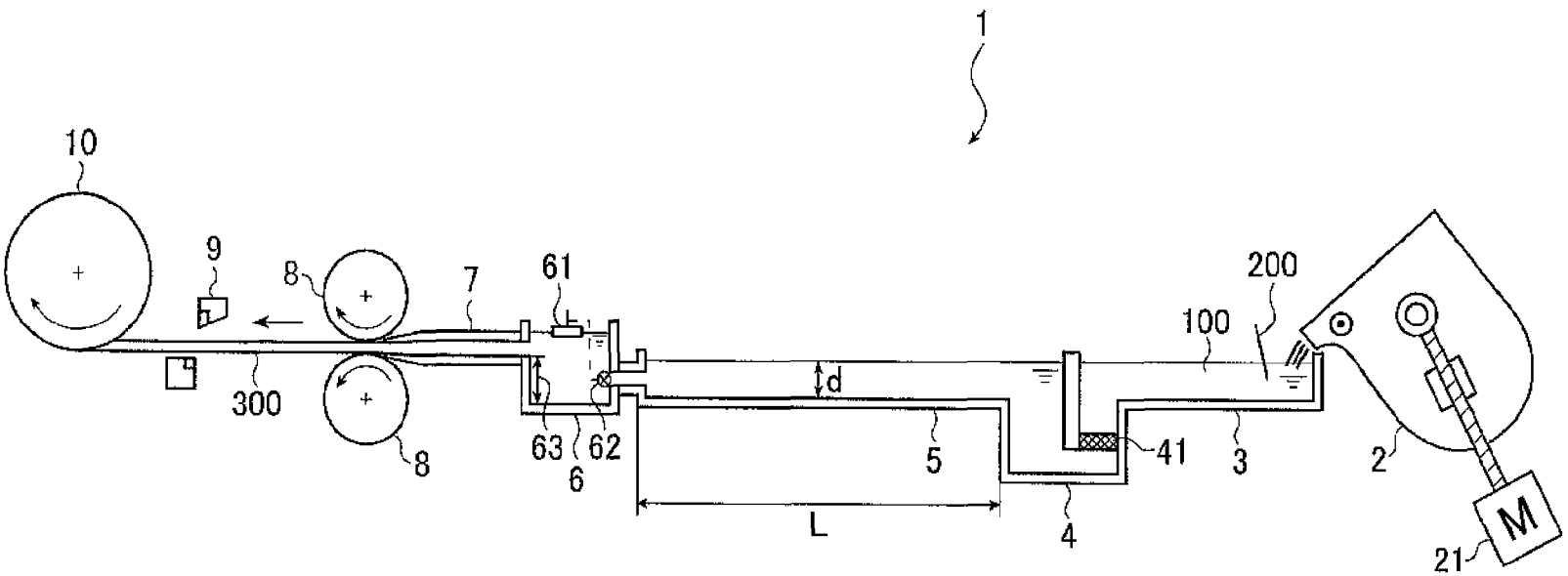
FIG. 1 is a schematic view of a continuous casting and rolling apparatus according to one aspect of the invention.

Preferred embodiments of the inventive method of manufacturing aluminum alloy strip for use in the production of lithographic printing plates are described more fully below in conjunction with the appended diagrams. FIG. 1 is a schematic view of an embodiment of a continuous casting and rolling apparatus for use in the inventive method of manufacturing aluminum alloy strip for lithographic printing plates. In the continuous casting and rolling apparatus 1 shown in FIG. 1, an aluminum melt (referred to below as the "melt") 100 obtained by melting aluminum alloy ingots is held in a melting and holding furnace 2.

When manufacturing aluminum alloy strip for lithographic printing plates, the melt contains aluminum as the primary ingredient and includes also trace amounts of other elements. Examples of the other elements include iron, silicon, copper, zinc, magnesium, manganese, boron and titanium. The total content of other elements in the melt is not more than 10 wt %. In the present specification, all indications of percent (%) signify percent by weight (wt %).

Preferred amounts of addition for each of the trace elements are explained.

Iron: The deliberate addition of iron is desirable because iron is an element which relates to the strength and alkali etching rate of the aluminum alloy strip. Preferably, $0.15\% \leqq Fe \leqq 0.50\%$; more preferably, $0.20\% \leqq Fe \leqq 50.45\%$; and even more preferably $0.25\% \leqq Fe \leqq 0.40\%$.

Silicon: The deliberate addition of silicon is desirable because silicon is an element which relates to the electrolytic graining properties and the alkali etching rate of the aluminum alloy strip. Preferably, $0.05\% \leqq Si \leqq 0.35\%$; more preferably, $0.08\% \leqq Si \leqq 50.20\%$; and even more preferably $0.09\% \leqq Si \leqq 0.15\%$.

Copper: Copper is an optional element which strongly relates to the electrolytic graining properties of the aluminum alloy strip. Preferably, $Cu \leqq 0.10\%$; more preferably, $Cu \leqq 0.05\%$; and even more preferably $0.001\% \leqq Cu \leqq 0.04\%$.

Zinc: Zinc may be included in an amount of $\leqq 0.05\%$ to control the electrochemical graining properties of the aluminum alloy strip within a desirable range.

Mg, Mn: Magnesium and manganese may be included in respective amounts of $Mg \leqq 1.5\%$ and $Mn \leqq 1.5\%$ to obtain an aluminum alloy strip having desirable mechanical properties.

Ti, B: Titanium and boron are furnished to the melt in the form of a grain refiner to prevent crack formation during casting. Grain refiners are described more fully later in the specification.

The balance of the melt is composed of aluminum and inadvertent impurities. Inadvertent impurities include, for example, chromium, zirconium, vanadium, beryllium and gallium. These may be present in amounts of up to 0.05% each. Most of the inadvertent impurities in the melt originate from the aluminum alloy ingot. If the inadvertent impurities in the melt are what is present in an ingot having an aluminum purity of, e.g., 99.7%, they will not compromise the intended objects of the invention. The inadvertent impurities may be, for example, impurities included in the amounts mentioned in *Aluminum Alloys: Structure and Properties*, by L. F. Mondolfo (1976).

The melting and holding furnace 2 has a furnace tilting mechanism 21 and is tilted by driving an electric motor on the furnace tilting mechanism 21. Tilting the melting and holding furnace 2 causes the melt 100 held in the furnace 2 to be poured into a first launder 3. The first launder 3 is provided with a level gauge (not shown) which detects the liquid level, or height, of the melt 100 within the launder 3. This level gauge is connected to the furnace tilting mechanism 21 through a controller (not shown). The controller controls the furnace tilting mechanism 21 based on the liquid level (height) of the melt 100 detected by the level gauge, thereby adjusting the liquid level (height) of the melt 100 within the first launder 3.

In the first launder 3, a grain refiner wire 200 made of a titanium and boron-containing aluminum alloy is added to the melt 100. The grain refiner wire 200 that has been added to the melt 100 melts within the melt 100, forming $TiB_2$ particles. These $TiB_2$ particles function as a grain refiner during casting. $TiB_2$ particles are lamellar particles which individually have a length of from 1 to 2 μm and a thickness of from 0.1 to 0.5 μm. However, these particles readily form agglomerates. If agglomerates 100 μm or larger in size are incorporated into the cast strip, after rolling and surface treatment have been carried out, they become visible as black streaks.

When the grain refiner wire 200 made of titanium and boron-containing aluminum alloy is added, it is desirable that the respective amounts of titanium and boron present in the melt 100 following addition of the grain refiner wire 200 fall within the following ranges.

Ti: preferably 0.005%≦Ti≦0.1%, more preferably 0.01%≦Ti≦0.05%, and even more preferably 0.012%≦Ti≦0.03%. B: preferably 0.001%≦B≦0.02%, more preferably 0.002%≦B≦0.01%, and even more preferably 0.0024%≦B≦0.006%.

FIG. 1 shows an example in which the grain refiner wire 200 is added and melted at the first launder 3. However, the invention is not limited in this regard. For example, the grain refiner wire 200 may instead be added at the melting and holding furnace 2.

The melt 100 to which the grain refiner wire 200 has been added at the first launder 3 is then sent, with the $TiB_2$ particles dispersed therein, to the filtering means 4.

Although not shown, a degassing device is typically provided at some point along the first launder 3. Degassing treatment (hydrogen gas removing treatment) within the melt 100 is preferably carried out after adding the grain refiner wire 200 and before carrying out filtering treatment. A commercially sold rotary-type degasser (e.g., Sniff degasser, GBF) may be used as the degassing device.

The filtering means 4 shown in FIG. 1 employs a ceramic foam filter 41 such as is commonly used for filtering aluminum melt in continuous casting and rolling apparatuses. The ceramic foam filter 41 used for this purpose is exemplified by ceramic foam filters having a thickness of 50 mm and a mesh size of 30 ppi.

When a ceramic foam filter 41, such as a ceramic foam filter having a thickness of 50 mm and a mesh size of 30 ppi is used as the filtering means 4, coarse $TiB_2$ particles having a size of 100 μm or more cannot be completely blocked; there is some degree of probability that coarse $TiB_2$ particles having a size of 100 μm or more will be carried off downstream. Moreover, if a gap of more than 100 μm exists where the ceramic foam filter 41 is attached, coarse $TiB_2$ particles having a size of 100 μm or more will slip through this gap and be carried downstream.

To reduce the possibility of coarse $TiB_2$ particles being carried off in this way, it is preferable to use the filtering means disclosed in JP 3549080 B; that is, a filtering means composed of a pre-filter chamber, a filter which blocks the passage of particles 10 μm or larger in size composed of compounds of titanium and boron, and a post-filter chamber, wherein the pre-filter chamber, the filter and the post-filter chamber are heated with a heater. It is preferable to use as the filter an aggregation of heat-resistant particles having a diameter of 5 mm or less, and more preferable to use a ceramic tube filter obtained by sintering heat-resistant particles having a diameter of 0.5 to 2.0 mm.

However, even when such a fine filtering means is used, there will be times where gaps on the order of several hundreds of microns arise depending on the method of installation and the closeness of the fit between the filtering means and the launder. In the course of carrying out casting over an extended period of time (i.e., during continuous casting, such as the casting of more than 50 metric tons), the possibility that coarse $TiB_2$ particles having a particle size of 100 μm or more will slip through such gaps cannot be entirely eliminated.

The coarse $TiB_2$ particles having a size of 100 μm or more that have slipped through the filtering means 4 settle over time, sinking to the bottom of the second launder 5. However, if the melt 100 has a high flow velocity or the second launder 5 has a short length, the coarse $TiB_2$ particles, instead of sinking to the bottom of the second launder 5, pass through the liquid level controlling means 6 and the melt feed nozzle 7 and are introduced into the cast strip 300, resulting in the undesirable formation of black streak-like defects.

In the inventive method of manufacturing aluminum alloy strip for use in the production of lithographic printing plates, by setting the time t in seconds required for the melt 100 to pass through the second launder 5 to at least a time defined by an empirical formula calculated according to the average flow velocity V in meters per second of the melt 100, the depth D in meters of the melt 100 in the second launder 5, the density and viscosity coefficient of the melt 100, and the density and particle size of the coarse $TiB_2$ particles, coarse $TiB_2$ particles having a size of at least 100 μm which have slipped through the filtering means 4 are allowed to settle to the bottom of the launder 5, thus preventing the coarse $TiB_2$ particles from moving downstream and reaching the liquid level controlling means 6 in FIG. 1.

Specifically, the time t (sec) required for the melt 100 to pass through the second launder 5 is made to satisfy the following formula (1):

$$t(\text{sec}) \geqq 270 \times 1.2 \times D \quad (1).$$

In formula (1), D stands for the depth (m) of the melt in the second launder 5.

The technical significance of formula (1) is explained below.

It is known that, generally, when a substance (particle) drops through a viscous fluid while incurring resistance by the fluid, the substance descends at a terminal velocity according to Stokes' law. That is, the resistance incurred from the viscous fluid rises as the velocity of the falling particle increases, converging on a fixed velocity of descent which is called the terminal velocity. The terminal velocity can be determined from the following formula (3) based on the Reynolds number (indicated below as "Re"). Given the conditions of the melt 100 herein and the size of the coarse $TiB_2$ particles, Re is less than 1; hence, investigations were conducted only for cases where Re<1.

When Re<1, the terminal velocity vt in meters per second is obtained as follows $$vt = g(\rho_p - \rho_f)d^2/(18 \times \mu) \quad (3),$$

wherein g: gravitational acceleration ($m/s^2$)

$\rho_p$: density of falling particle ($kg/m^3$)

$\rho_f$: density of viscous fluid ($kg/m^3$)

d: diameter of falling particle (m)

μ: viscosity coefficient (Pa·s)

Also, Re=vxdxp$_f$/p, wherein v is the relative velocity between the viscous fluid and the particle.

In formula (3), letting g=9.8 $m/s^2$, $\rho_p$ for coarse $TiB_2$ particles=4400 $kg/m^3$, $\rho_f$ for the melt 100=2400 $kg/m^3$, the diameter d of the coarse $TiB_2$ particles=100 μm=0.0001 m, and p for the melt 100=0.0029 Pa·s, the terminal velocity vt=3.75×$10^{-3}$ m/s.

The time t it takes for a coarse $TiB_2$ particle to move at this terminal velocity vt the distance from the surfacemost layer of the melt 100 in the second launder 5 to the bottom of the second launder 5 (i.e., the melt depth D in the second launder 5) is given by $$t = D/vt \approx 270D.$$

Referring to the above, using a simulated viscous fluid (a liquid prepared by adding polyvinyl alcohol to water and adjusting the viscosity coefficient μ to 0.0029 Pa·s; density, about 1000 $kg/m^3$) and simulated particles (silicon nitride ($Si_3N_4$); particle size, about 100 μm; density=about 3000 $kg/m^3$) adjusted so that the density difference with the simulated viscous fluid is the same as the density difference between coarse $TiB_2$ particles and the melt 100 (4400 $kg/mm^3$−2400 $kg/mm^3$=2000 $kg/mm^3$) in a simulation launder test apparatus made of clear polyvinyl chloride and modeled on the second launder 5 and the liquid level controlling means 6 in FIG. 1, the time it took for the simulated particles to sink from the surface layer of the melt 100 in the second launder 5 to the bottom of the second launder 5 while the simulated viscous fluid flowed in the horizontal direction was measured and found to be somewhat longer than t=D/vt≈270D.

With repeated experimentation under various conditions, it was found that by setting t=1.2×D/vt≈270×1.2×D, the simulated particles having a diameter of about 100 μm settle within the second launder 5 and do not reach the simulated liquid level controlling means 6.

Therefore, by having the time t required for the melt 100 to pass through the second launder 5 satisfy above formula (1), coarse $TiB_2$ particles with a diameter of 100 μm or more are allowed to sink to the bottom of the second launder 5, enabling these coarse $TiB_2$ particles to be prevented from reaching the liquid level controlling means 6. Accordingly, the larger the value of t, the more likely the coarse $TiB_2$ particles will be to sink to the bottom of the second launder 5. However, if the value of t is made too large, there is a possibility that the temperature of the melt 100 will decrease as it passes through the second launder 5 and that some of the melt 100 will thus begin to solidify. From this standpoint, it is preferable for t to be not more than 150 seconds, more preferably not more than 120 seconds, and even more preferably not more than 90 seconds.

The time t required for the melt 100 to pass through the launder 5 can be controlled by a method that involves changing the depth D of the melt in the second launder 5, by a method that involves changing the casting speed and thereby changing the flow velocity of the melt 100, by a method that involves changing the length L of the second launder 5 (which method is described below), or by a combination of any these methods.

Any value will not do as the depth D of the melt in the second launder 5. For good temperature stability of the melt 100, the depth D is preferably from 0.05 to 0.4 m, more preferably from 0.10 to 0.30 m, and even more preferably from 0.10 to 0.25 m.

In the method that involves changing the length L of the second launder 5, the length L (m) of the second launder 5 should be changed so as to satisfy the following formula (2).

$$4 \geqq L \geqq V \times 270 \times 1.2 \times D \quad (2).$$

In formula (2), V is the flow velocity (m/s) of the melt 100 in the second launder 5, and D is the depth (m) of the melt in the second launder 5.

The flow velocity V of the melt 100 in the second launder 5 can be determined as the average flow velocity within the second launder 5 by dividing the amount of the melt 100 that is fed per unit time by the cross-sectional surface area of the second launder 5. The amount of melt 100 fed per unit time can be accurately calculated, based on the weight per unit time of the cast strip 300, by using the density of the cast strip 300 (2700 kg/m$^3$) and the density of the melt 100 (2400 kg/m$^3$).

Letting the average flow velocity in the horizontal direction of the melt 100 in the second launder 5 be V (m/s), the distance L that the melt 100 moves through the second launder 5 in the horizontal direction in time t (i.e., the time it takes for coarse $TiB_2$ particles to move the depth D of the melt in the second launder 5) is given by $$L = V \times t = 270 \times 1.2 \times D \times V.$$

Therefore, by making the length L of the second launder greater than 270×1.2×D×V, coarse $TiB_2$ particles having a diameter of 100 μm or more can be allowed to sink to the bottom of the second launder 5 and thus prevented from reaching the liquid level controlling means 6. Accordingly, the larger the value of L, the more likely the coarse $TiB_2$ particles will be to sink to the bottom of the second launder 5. However, if the value of L is made too large, there is a possibility that the temperature of the melt 100 will decrease as it passes through the second launder 5 and that some of the melt 100 will thus begin to solidify. Hence, L must be kept from exceeding 4 m, and should preferably be 3 m or less.

In the diagrams, the liquid level controlling means is designated as 6. Here, the liquid level of the melt 100 within the liquid level controlling means 6 is kept substantially constant by opening and closing a valve 62 in accordance with a liquid level sensor 61 so as to control the feed rate of the melt 100. The outlet side opening of the liquid level controlling means 6 communicates with the melt feed nozzle 7. The melt feed nozzle 7 feeds the melt 100 between two cooled rolls 8,8 which have been positioned so as to maintain a fixed gap therebetween (e.g., a gap of from several millimeters to about 10 mm).

$TiB_2$ particles having a size of less than 100 μm function as a grain refiner when continuous casting is carried out by feeding the melt 100 from the melt feed nozzle 7 between the two cooled rolls 8,8. Because the $TiB_2$ particles have a specific gravity of about 4.4 g/cm$^2$, which is large compared to the specific gravity of about 2.4 g/cm$^2$ for the aluminum within the melt 100, even $TiB_2$ particles having a size of less than 100 μm gradually settle toward the bottom of the launder as they move downstream, with some of these particles collecting at the bottom of the second launder 5, the bottom of the liquid level controlling means 6 and the bottom of the melt feed nozzle 7.

When casting is carried out for an extended period of time (i.e., during continuous casting, such as the casting of more than 50 metric tons), the $TiB_2$ particles having a size of less than 100 μm which have collected at the bottom of the second launder 5, the liquid level controlling means 6 and the melt feed nozzle 7 eventually agglomerate, forming coarse $TiB_2$ particles with a size of 100 μm or more. These coarse $TiB_2$ particles are sometimes carried off downstream as a result of, for example, changes in the flow velocity of the melt 100, becoming incorporated into the cast strip and ultimately giving rise to undesirable black streak-like defects.

Similarly, although coarse $TiB_2$ particles having a size of 100 μm or more that have slipped through the filtering means 4 do settle to the bottom of the second launder 5 whose length L satisfies the above formula (2), these coarse $TiB_2$ particles or even coarser particles that form as a result of agglomeration about coarse $TiB_2$ particles as the nucleus may be carried off downstream as a result of, for example, changes in the flow velocity of the melt 100, becoming incorporated into the cast strip and ultimately giving rise to undesirable black streak-like defects.

To prevent the above problem caused by $TiB_2$ particles that have settled to the bottom of the second launder 5, the liquid level controlling means 6 and the melt feed nozzle 7, it is preferable to provide, within the liquid level controlling means 6 and/or on the melt feed nozzle 7, means for trapping settled particles present in the aluminum melt 100.

Figure 2:
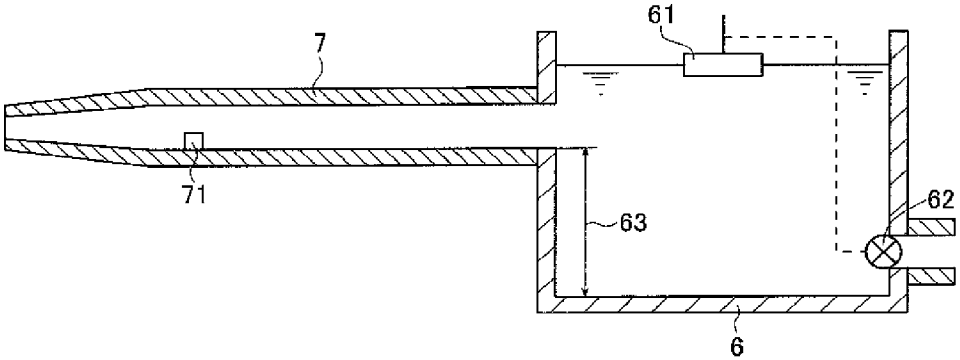
FIG. 2 shows a preferred embodiment of the liquid level controlling means and the melt feed nozzle in the continuous casting and rolling apparatus shown in FIG. 1.

FIG. 2 shows a preferred embodiment of the liquid level controlling means 6 and the melt feed nozzle 7. In FIG. 2, an opening on the outlet side of the liquid level controlling means 6 which communicates with the melt feed nozzle 7 is provided at elevated position with respect to the bottom surface of the liquid level controlling means 6 in such a way that there exists a step 63 between the opening and the bottom surface. This step 63 functions as a means for trapping settled particles within the aluminum melt; more specifically, it functions as a trapping means which prevents $TiB_2$ particles that have settled to the bottom of the second launder 5 and the bottom of the liquid level controlling means 6 from being carried downstream on account of, for example, changes in the flow velocity of the melt 100.

In FIG. 2, a transversely extending dam-like step 71 is provided within the melt feed nozzle 7. This step 71 functions as a means for trapping settled particles within the melt 100, and more specifically as a trapping means for preventing $TiB_2$ particles that have settled to the bottom of the second launder 5, the bottom of the liquid level controlling means 6 and the bottom of the melt feed nozzle 7 from being carried out to the downstream side due to, for example, changes in the flow velocity of the melt 100.

Figure 3:
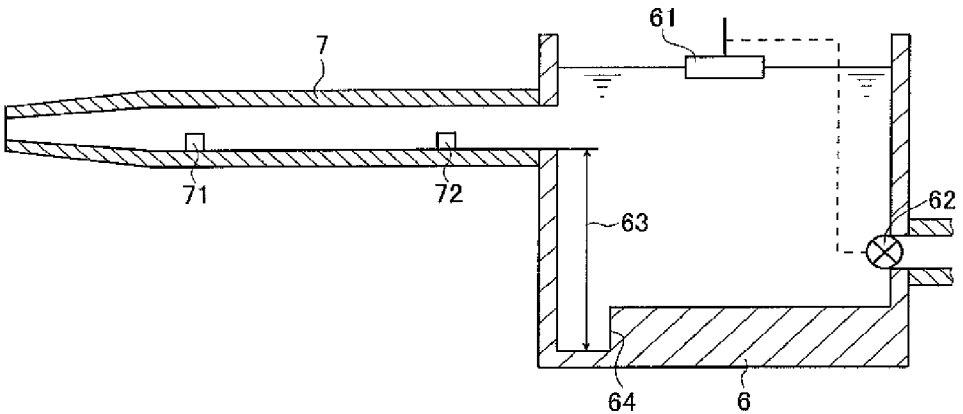
FIG. 3 shows another preferred embodiment of the liquid level controlling means and the melt feed nozzle in the apparatus shown in FIG. 1.

FIG. 3 shows another preferred embodiment of the liquid level controlling means 6 and the melt feed nozzle 7. In FIG. 3, the bottom surface on the downstream side of the liquid level controlling means 6 is provided with a recess 64 having an even lower bottom surface. The presence of this recess 64 increases the size of the step 63 that functions as a means for trapping settled particles in the melt 100. In addition, the recess 64 itself functions as a means for trapping settled particles in the melt 100.

Alternatively, as shown in FIG. 3, two dam-like steps 71, 72 which function as means for trapping settled particles in the melt 100 may be provided within the melt feed nozzle 7.

In the liquid level controlling means 6, the size of the step 63 which functions as a means for trapping settled particles within the melt 100 is not subject to any particular limitation and may be suitably selected as needed. Moreover, the number of trapping means provided in the melt feed nozzle 7, i.e., the number of dam-like steps 71, 72 provided so as to extend across the nozzle 7 in the transverse direction, is not subject to any particular limitation and may be suitably selected as needed. The height of the dam-like steps 71, 72 within the melt feed nozzle 7, to keep from hindering the flow of the melt 100 within the melt feed nozzle 7, is preferably set to a height of not more than one-half the vertical dimension of the melt passageway within the melt feed nozzle 7.

When continuous casting has been carried out for a very long time, even if trapping means, i.e., dam-like steps 71 and 72, are provided within the melt feed nozzle 7, the possibility that coarse $TiB_2$ particles which have collected at the bottom of the nozzle 7 will be carried away downstream increases, making it desirable to replace the melt feed nozzle 7 during the casting operation.

The cooled rolls 8,8 have a surface made of iron and a water-cooled construction at the interior, enabling solidification and hot rolling of the melt 100 furnished from the melt feed nozzle 7 to be carried out at the same time. The cooled rolls 8,8 shown in FIG. 1, as in commonly known rolling machines, are arranged on a line perpendicular to the ground. However, the invention is not limited in this regard. Other possible arrangements include one, familiar as a type of continuous casting machine marketed by Hunter Engineering, in which the two cooled rolls are tilted about 15° degrees from a line perpendicular to the ground; and an arrangement in which the two cooled rolls are disposed at positions which are parallel to the ground (the type of continuous casting machine initially marketed by Hunter engineering).

The continuous cast strip (aluminum alloy plate) 300 obtained by continuous casting has a gauge which, from the standpoint of the efficiency of cold rolling that is subsequently carried out, is preferably thin, and is typically set to from 1 to 10 mm. The continuous cast strip (aluminum alloy strip) 300 is then taken up into a coil by a winder 10. The strip is suitably cut with a cutter 9.

In the inventive method of manufacturing aluminum alloy strip for use in the production of supports for lithographic printing plates, after carrying out the casting process composed of the above-indicated operations and forming a continuous cast strip (aluminum alloy strip) 300, cold rolling, intermediate annealing, finish cold-rolling and flatness correction are then carried out by conventional operations. These latter operations are explained below.

Cold Rolling

Figure 4:
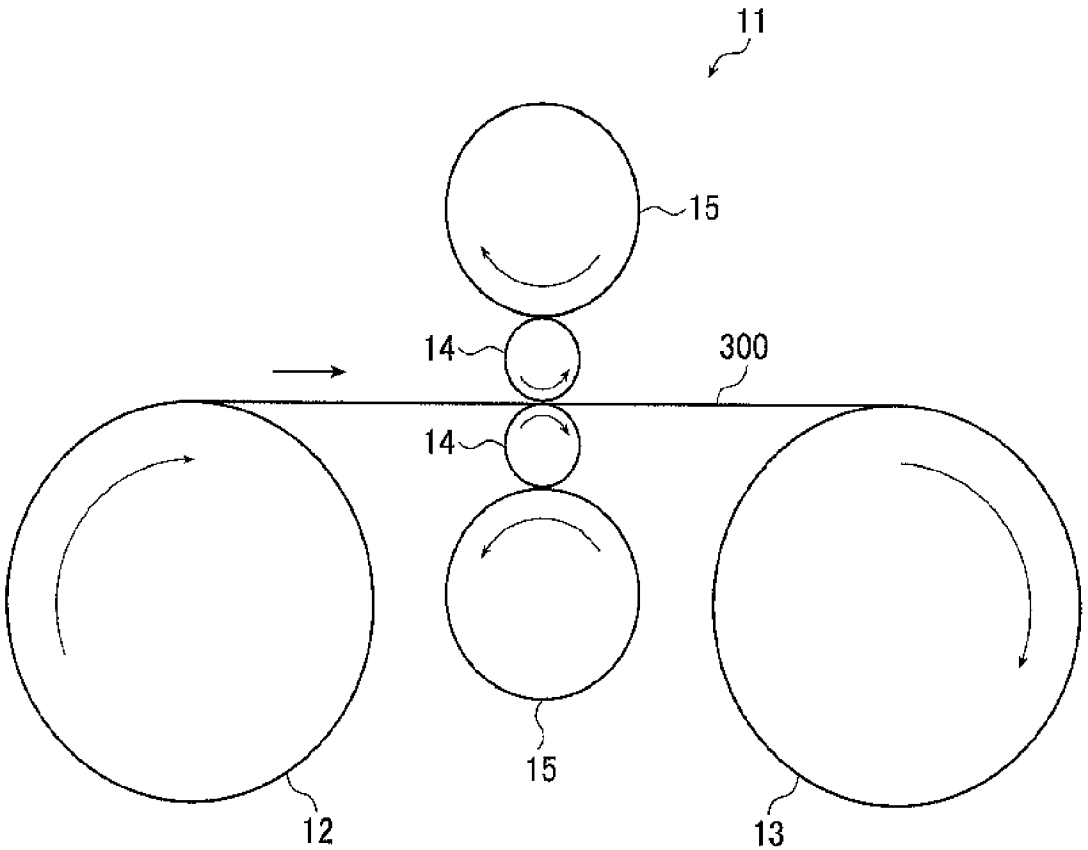
FIG. 4 is a schematic view showing a cold rolling mill such as may be used in cold rolling.

In the continuous casting and rolling apparatus 1 shown in FIG. 1, cold rolling is carried out on a continuous cast strip (aluminum alloy strip) 300 that has been suitably cut with a cutter 9 and taken up into a coil by winder 10. Cold rolling is an operation which reduces the gauge of the continuous cast strip (aluminum alloy strip) 300 produced by the continuous casting and rolling apparatus 1 shown in FIG. 1, thereby setting the continuous cast strip (aluminum alloy strip) 300 to the desired thickness. Cold rolling may be carried out by a method known to the art. FIG. 4 is a schematic diagram showing an example of a cold rolling mill such as may be used for cold rolling. The cold rolling mill 11 shown in FIG. 4 carries out cold rolling by using a pair of cold-rolling rollers 14, each of which is rotated by a supporting roller 15, to apply pressure to a continuous cast strip (aluminum alloy strip) 300 which travels between a delivery coil 12 and a take-up coil 13.

Intermediate Annealing

After the cold rolling step, intermediate annealing is carried out. Intermediate annealing is a step in which the continuous cast strip (aluminum alloy strip) from the cold rolling step is heat treated.

A continuous casting step, unlike a process that uses a conventional stationary mold for casting, is capable of cooling and solidifying the melt very rapidly. Consequently, crystal grains within the continuous cast strip (aluminum alloy strip) obtained by continuous casting can be refined to a much greater degree than is possible with a process that uses a conventional stationary mold. However, because the resulting crystal grains are still rather large, appearance defects (surface treatment irregularities) attributable to the size of the crystal grains tend to arise when the aluminum alloy strip, after being finish cold-rolled, is subjected to graining treatment and thereby rendered into a support for a lithographic printing plate.

Hence, when intermediate annealing is carried out after the buildup of strain in the above-described cold rolling step, the dislocations that have accumulated in the cold rolling step are released and re-crystallization occurs, enabling the crystal grains to be refined even further. Specifically, the crystal grains can be controlled by the reduction ratio in the cold rolling step and the heat treatment conditions (especially the temperature, time and temperature rise rate) in the intermediate annealing step.

For example, the temperature rise rate is generally set in a range of from about 0.5° C./min to about 500° C./min, although the formation of smaller crystal grains can be promoted by setting the temperature rise rate in continuous annealing to 10° C./sec or more and by shortening the holding time after temperature rise (to at most 10 minutes, and preferably 2 minutes or less). In batch-type annealing, although the temperature rise rate cannot be made rapid in the manner of continuous annealing, it is possible to control the crystal grain size by controlling the holding temperature.

Finish Cold Rolling

After intermediate annealing, a finish cold rolling step is carried out. Finish cold rolling reduces the gauge of the intermediate annealed continuous cast strip (aluminum alloy strip). The gauge of the strip following the finish cold rolling step is preferably from 0.1 to 0.5 mm.

Finish cold rolling may be carried out by a method known to the art. For example, finish cold rolling may be carried out by a method similar to the cold rolling step carried out prior to the above-described intermediate annealing step.

Flatness Correction

Flatness correction is a step in which the flatness of the continuous cast strip (aluminum alloy strip) is corrected.

The flatness correcting step may be carried out by a method known to the prior art. For example, this step may be carried out using a straightening machine such as a roller leveler or a tension leveler.

Figure 5:
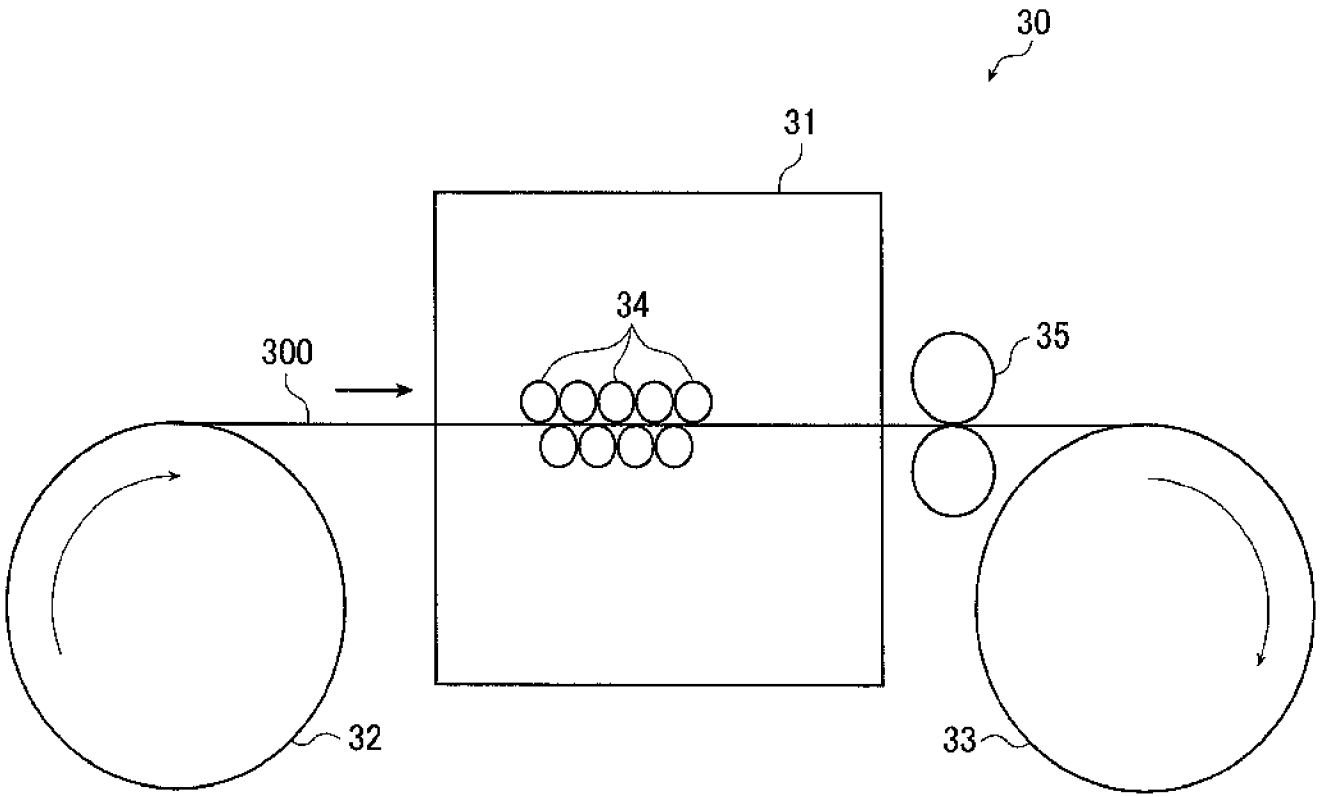
FIG. 5 is a schematic view of a straightening machine.

FIG. 5 is a schematic showing an example of a straightening machine. The straightening machine 30 shown in FIG. 5 improves the flatness of a continuous cast strip (aluminum alloy strip) 300 traveling between a delivery coil 32 and a take-up coil 33 while applying tension to the plate with a leveler 31 that includes work rolls 34. The plate is then cut to a given width with a slitter 35.

An aluminum alloy strip for use in the production of lithographic printing plates is obtained via the above-described casting step, cold rolling step, intermediate annealing step, finish cold-rolling step and flatness correcting step.

By using the above-described inventive method for manufacturing aluminum alloy strip for lithographic printing plates, even when casting has been carried out for an extended period of time (i.e., even when continuous casting, such as the casting of more than 50 metric tons, has been carried out), the formation of black streaks as a result of coarse $TiB_2$ particles 100 μm or more in size being carried downstream and becoming incorporated into the cast strip can be prevented from occurring.

When an aluminum alloy strip for lithographic printing plates is manufactured by a continuous casting process, in addition to black streaks, other problems specific to continuous casting sometimes arise.

For example, when non-uniformities in composition associated with the uneven distribution of iron to the surface of the aluminum alloy strip arise, such non-uniformities become visible as appearance defects during surface treatment. Also, because the melt is directly solidified and rendered into a low-gauge strip having a gauge of 10 mm or less, disruptions in stability during solidification may readily give rise to appearance defects during surface treatment.

Moreover, unlike in conventional methods of manufacture, due to the absence of a hot rolling step, any non-uniformities in the metal crystals that arise during solidification tend to continue to exert an influence even when the cast strip has been rendered into a low-gauge strip by repeated rolling.

Also, in order to directly solidify the melt and render it into a low-gauge strip, it must pass through a cooling step that is very rapid compared with conventional manufacturing methods. As a result, the dimensions and distribution of intermetallic compounds which form within the aluminum alloy strip differ from those in aluminum alloy strip manufacturing by conventional manufacturing methods, in addition to which the amounts of trace elements in solid solution within the aluminum alloy strip tend to differ. Hence, when such aluminum alloy strip for lithographic printing plates is subjected to electrochemical graining treatment, the electrochemical graining properties may differ significantly from those of aluminum alloy strips manufactured by conventional methods.

By including also, in the inventive method of manufacturing aluminum alloy strip for lithographic printing plates, measures for preventing such defects other than black streaks, it is possible to manufacture defect-free aluminum alloy strip for lithographic printing plates having an even better yield.

As an example of a measure for preventing defects other than black streaks, by setting the temperature distribution of the melt 100 in the melt feed nozzle 7 to within 30° C. at the nozzle 7 tip, iron distribution and crystal grain non-uniformities can be prevented during casting, thus enabling the suppression of both streak defects and irregularities in surface properties.

Also, by setting the temperature of the cast strip (aluminum alloy strip) 300 immediately after the melt 100 has been rolled while being solidified with the pair of cooled rolls 8,8 to the recrystallization temperature or higher, non-uniformities in the crystal grains can be prevented, enabling the suppression of irregularities in the surface properties.

Alternatively, an aluminum alloy strip for lithographic printing plates which has a tensile strength of at least 15 $kg/mm^2$ and which has an offset yield strength of at least 10 $kg/mm^2$ when heat-treated by being held for 7 minutes at a heating temperature of 300° C. can be manufactured as follows. A melt 100 prepared using JIS1050 alloy as the aluminum starting material is rolled while being solidified with a pair of cooled rolls 8,8 so as to form an aluminum alloy strip 300. Next, in a cold rolling step, the strip is cold-rolled to a gauge of from 1.5 to 3.4 mm, then intermediate annealing is carried out at 450 to 600° C. for a period of from 10 minutes to 10 hours, after which a finish cold rolling step and a flatness correcting step are carried out, thereby giving aluminum alloy strip for lithographic printing plates which has a gauge of from 0.1 to 0.5 mm.

Because this aluminum alloy strip has a stable mechanical strength and can be uniformly grained when electrochemical graining treatment is carried out, it is well-suited for use in the production of supports for lithographic printing plates. The aluminum alloy strip manufactured by the above-described operations has the outstanding properties indicated above because the amounts of iron and silicon that enter into solid solution within the aluminum alloy stabilize. In particular, by slowing the rate of temperature rise during intermediate annealing to 10° C./sec or less, the amounts of iron and silicon that enter into solid solution within the aluminum alloy and the amounts of iron and silicon which precipitate from the aluminum alloy are further stabilized.

In addition, although not a measure intended specifically to prevent defects, the effective use of starting materials is possible by employing an aluminum starting material which contains at least 1% of spent lithographic printing plate having attached thereto photosensitive layer, photosensitive layer protecting material, packaging material and pressure-sensitive adhesive tape. Prior to casting, aluminum melt treatment with a gas that is inert and has a high heat resistance (such as argon or nitrogen) and filtration with a filtering medium are carried out to remove impurities and hydrogen gas. Casting is then carried out.

Aluminum alloy compositions preferable for enhancing the uniformity of the surface-treated appearance in the transverse direction of the strip contain $0.15\% \leqq Fe \leqq 0.5\%$, $0.05\% \leqq Si \leqq 0.35\%$ and $0.01\% \leqq Ti \leqq 0.1\%$, with the total amount of other alloying elements being $\leqq 0.3\%$. At the final strip thickness, i.e., at a strip gauge of from 0.1 to 0.5 mm, it is desirable for the distribution in the concentration of ferroalloy constituents in the surface layers of the aluminum alloy strip to be within ±0.05% of the average concentration, and it is desirable that places where the iron concentration of the aluminum alloy strip surface layers is 1% or more account for between 0.01 and 10% of the total surface. Also, to this end, it is effective to set the temperature distribution of the melt 100 in the melt feed nozzle 7 to within 30° C. at the tip of the nozzle 7, and to carry out intermediate annealing at 450 to 600° C. for a period of from 10 minutes to 10 hours. In addition, it is effective for the finish cold-rolling step which is carried out after intermediate annealing to be conducted so that the temperature of the aluminum alloy during cold rolling is from 100 to 250° C.

Defects that arise from casting can be suppressed by subjecting the melt 100 prior to casting to hydrogen gas removal treatment so as to set the hydrogen gas concentration in the melt 100 following hydrogen gas removal treatment to 0.12 cc/100 g or less and the hydrogen gas concentration in the melt 100 following filtration treatment to 0.15 cc/100 g or less.

To further stabilize electrochemical graining, it is also effective to include within the melt 100 from 0.01 to 0.20% of copper.

The stability of casting can be improved even further by combining the following methods. Specifically, by using an aluminum alloy starting material which contains titanium and having the relationship between the temperature of the melt 100 just prior to the melt feed nozzle 7 at the start of casting and the amount of titanium present in the melt 100 satisfy the following three formulas, the stability at the start of casting can be increased.

$$\{Ti\} \geqq 2\times10^{-6}\times(T-700)^2-3\times10^{-4}\times(T-700)+0.015 \quad \text{Formula A}$$

$$\{Ti\} \leqq 2\times10^{-5}\times(T-700)^2-2.4\times10^{-3}\times(T-700)+0.1 \quad \text{Formula B}$$

$$700 \leqq T \leqq 790 \quad \text{Formula C}$$

Here, {Ti} represents the titanium concentration (%) in the melt 100, and T is the temperature (° C.) of the melt 100 just prior to the melt feed nozzle 7.

If non-uniformities arise on the cooled rolls 8,8 during casting, areas where the cooling rate is non-uniform will endlessly arise at the same place in the width direction, leaving abnormalities. It is thus desirable to continuously or intermittently apply a fine particle-containing liquid suspension to the surfaces of the cooled rolls 8,8 as a parting material for rendering uniform the state of contact with the melt 100. It is preferable for the fine particles present in the liquid suspension to have an average particle size of from 0.7 to 1.5 μm and a median diameter of from 0.5 to 1.2 μm; for less than 5% of all the particles to be 0.2 μm or smaller, less than 10% of all the particles to be 0.4 μm or smaller, less than 10% of all the particles to be 2 μm or larger, and less than 5% of all the particles to be 3 μm or larger; and for the amount of the liquid suspension applied to the surfaces of the cooled rolls 8,8 to be from 60 to 1200 mg/m$^2$. In addition, it is preferable to monitor the load applied to the cooled rolls 8,8 and, by changing the amount of the liquid suspension applied in keeping with fluctuations in the load, to prevent the melt 100 from sticking to the cooled rolls 8,8.

The liquid suspension applied to the cooled rolls 8,8 is preferably composed of carbon particles having the above-described particle size distribution.

When partial solidification of the melt 100 arises within the melt feed nozzle 7, solidification abnormalities endlessly arise at the same place in the width direction, leading to conspicuous appearance defects when surface treatment for lithographic plate production has been carried out. An effective way to overcome this problem is to lower the wettability of the inside surface of the melt feed nozzle 7 by the melt 100 so that partial solidification of the melt 100 does not occur. Specifically, it is desirable to use a melt feed nozzle 7 in which the surfaces that come into contact with the melt 100 have been coated with a parting material containing aggregate particles having a particle size distribution such that the median diameter is from 5 to 20 μm and the modal diameter is from 4 to 12 μm. Boron nitride is especially preferred as the aggregate particles in the parting material.

To discourage the melt 100 from sticking to the melt feed nozzle 7, it is desirable for the inside surface of the melt feed nozzle 7 to have an average surface roughness Ra of from 1.0 to 3.0 μm.

Even when the above steps are taken, because solidification of the melt 100 entails the melt 100 which has exited the melt feed nozzle 7, within a very narrow space, forming a meniscus, coming into contact with the melt feed nozzle 7 and solidifying, sometimes the solidification starting point moves back and forth, leading to casting problems. For example, if the solidification starting point moves downstream, the melt 100 which has not fully solidified may begin melting again, causing casting of the melt to be interrupted. On the other hand, if the solidification starting point moves upstream, solidification of the melt 100 occurs within the melt feed nozzle 7, in which case abnormal solidification structures called "tiger marks" are known to arise on the surface of the cast strip 300. To prevent this from happening, it is important to stabilize the solidification point. Specifically, it is advantageous for the circumferential speed of the cooled rolls 8,8 which plays a role in the feeding speed of the melt 100 to be set in a stable region based on the diameter of the cooled rolls 8,8 which affects the cooling performance of the cooled rolls 8,8 and the gauge of the cast strip 300 which influences the solidification temperature. Specifically, it is preferable for the circumferential velocity of the cooled rolls 8,8 to satisfy the following empirical formula:

$$V \geqq 5\times10^{-5}\times(D_{roll}/t^2)\ \text{(m/min)}$$

Here, D represents the circumferential velocity of the cooled rolls 8,8 in meters per minute, t is the gauge of the cast strip 300 in meters, and $D_{roll}$ is the diameter of the cooled rolls 8,8 in meters.

To stabilize the melt 100 meniscus, it is desirable for the gap between the melt feed nozzle 7 and the cooled rolls 8,8 to be zero (i.e., for the nozzle to be in a state of contact with the rolls) or small. To this end, it is desirable for the melt feed nozzle 7 to have a construction which includes a top plate member that contacts the melt 100 from above and a bottom plate member that contacts the melt 100 from below, each of which plate members is vertically movable, so that the top plate member and the bottom plate member are pushed against the surfaces of the respective adjoining cooled rolls 8,8 under pressure exerted thereto by the melt 100. Moreover, because the top plate member and the bottom plate member are placed in constant contact at the tips thereof with the cooled rolls 8,8, it is preferable for the melt feed nozzle 7 to have a nozzle opening with an outer edge which contacts the cooled rolls 8,8 and has an outer periphery with a recessed relief therein that avoids contact with the cooled rolls 8,8. To keep the melt feed nozzle 7 from breaking, it is desirable for a supporting member made of a material having a higher flexural strength than the material making up the nozzle 7 to be disposed at intervals of 200 mm or less in the transverse direction of the nozzle 7 so as to support the tip of the nozzle 7. The melt feed nozzle 7 is preferably made of a heat-resistant material having a flexural strength of at least 10 MPa. It is desirable for the heat-resistant material of which the melt feed nozzle 7 is composed to be a ceramic material containing one or more selected from among $ZrO_2$, $Al_2O_3$, $Si_3N_4$, SiC, $SiO_2$ and aluminolithium silicates.

When manufacturing lithographic printing plate supports from the aluminum alloy strip for lithographic printing plates produced by the above-described operations, the aluminum alloy strip is subjected to the surface treatment operations described below. While it is not necessary to carry out all of these surface treatment operations, graining treatment and anodizing treatment are essential. Also, the number of times these surface treatments are carried out, while not subject to any particular limitation, is preferably at least two times.

Surface Treatment (Graining)

The aluminum alloy strip for lithographic printing plates is subjected to graining treatment to impart a desirable surface shape. Illustrative examples of suitable graining methods include mechanical graining, chemical etching and electrolytic graining like those described in JP 56-28893 A. Use can also be made of electrochemical graining and electrolytic graining processes in which the surface is electrochemically grained in an electrolytic solution containing hydrochloric acid or nitric acid; and mechanical graining such as wire brushing in which the surface of the aluminum alloy strip for lithographic printing plates is scratched with metal wires, ball graining in which the surface of the aluminum alloy strip is grained with abrasive balls and an abrasive compound, and brush graining in which the surface is grained with a nylon brush and an abrasive compound. Any one or combination of these graining methods may be used. For example, mechanical graining with a nylon brush and an abrasive compound may be combined with electrolytic graining using an electrolytic solution of hydrochloric acid or nitric acid, or a plurality of electrolytic graining treatments may be combined.

In the case of brush graining, the average depth of long-wavelength component (large-wave) recesses on the surface of the lithographic printing plate substrate can be controlled by appropriate selection of such conditions as the average and maximum diameters of the particles used as the abrasive, the diameter and density of the bristles on the brush, and the force with which the brush is pressed against the substrate. The recesses obtained by brush graining have an average wavelength of preferably from 2 to 30 μm, and an average depth of preferably from 0.3 to 1 μm.

Electrochemical graining treatment is preferably an electrochemical process in which chemical graining is carried out in an electrolytic solution of hydrochloric acid or an electrolytic solution of nitric acid; i.e., electrolytic graining treatment using an electrolytic solution of hydrochloric acid or an electrolytic solution nitric acid. The current density is preferably such that the amount of electricity at the anode is from 50 to 400 $C/dm^2$. Specifically, treatment may be carried out within, for example, an electrolytic solution containing from 0.1 to 50 wt % of hydrochloric acid or nitric acid, at a temperature of 20 to 100° C., for a period of from 1 second to 30 minutes, and at a current density of from 100 to 400 $C/dm^2$ using either a direct current or an alternating current. By carrying out such electrolytic graining treatment using an electrolytic solution of hydrochloric acid or nitric acid, a fine surface texture can easily be provided on the aluminum alloy plate, thereby making it possible to increase adhesion between the image recording layer and the support.

Alkali Etching Treatment

The aluminum alloy strip for lithographic printing plates that has been subjected to graining treatment as described above is preferably chemically etched with an alkaline surface treatment solution. Examples of alkaline surface treatment solutions that may be advantageously used in the invention include, but are not limited to, solutions of sodium hydroxide, sodium carbonate, sodium aluminate, sodium metasilicate, sodium phosphate, potassium hydroxide and lithium hydroxide. Alkali etching is preferably carried out under conditions that result in an amount of aluminum dissolution of from 0.05 to 5.0 $g/m^2$. In particular, when alkali etching is carried out after electrochemical graining, the amount of aluminum dissolution is preferably not more than 0.5 $g/m^2$. The other conditions are likewise not subject to any particular limitation. However, the concentration of the alkaline surface treatment solution is preferably from 1 to 50 wt %, and more preferably from 5 to 30 wt %; and the temperature of the alkaline surface treatment solution is preferably from 20 to 100° C., and more preferably from 30 to 50° C. Alkali etching treatment is not limited to one type of method, and may instead involve a plurality of steps used in combination.

Following alkali etching treatment, acid pickling (desmutting) is carried out to remove products (smut) such as hydroxides and oxides (smut) remaining on the surface. Examples of acids that may be used for this purpose include nitric acid, sulfuric acid, phosphoric acid, chromic acid, hydrofluoric acid and tetrafluoroboric acid. Desmutting after electrolytic graining treatment may be carried out by a method such as that described in JP 53-12739 A in which the aluminum alloy strip is brought into contact with a 16 to 65% sulfuric acid aqueous solution at a temperature of 50 to 90° C.

Anodizing Treatment

By subjecting the aluminum alloy strip for lithographic printing plates that has been treated as described above to anodizing treatment so as to improve the surface hardness and adhesion with an image recording layer, a lithographic printing plate support can be obtained. This treatment creates an anodized layer on the surface of which exceedingly small recesses known as micropores are formed. Specifically, a direct current or alternating current is passed through the aluminum alloy strip for lithographic printing plates in a sulfuric acid electrolytic solution which contains sulfuric acid as the primary ingredient and which may also include, as needed, other acids such as phosphoric acid, chromic acid, oxalic acid, sulfamic acid and benzenesulfonic acid, thereby forming an anodized layer on the surface of the aluminum alloy strip. The micropores have the effect of enhancing adhesion with the image recording layer.

The anodizing treatment conditions change in various ways depending on the electrolytic solution used, and thus cannot be strictly specified. However, it is generally suitable for the electrolytic solution to have a concentration of from 1 to 15%, for the solution temperature to be from −5 to 40° C., for the current density to be from 5 to 60 $A/dm^2$, for the voltage to be from 1 to 200 V, and for the electrolysis time to be from 10 to 200 seconds.

The anodized layer has a weight of preferably from 1 to 5 $g/m^2$. At a weight of less than 1 $g/m^2$, the support tends to mar too easily. On the other hand, at more than 5 $g/m^2$, the large amount of electrical power required for production is not cost-effective. The weight of the anodized layer is more preferably from 1.5 to 4 $g/m^2$.

Alkali Metal Silicate Treatment

If necessary, the lithographic printing plate support obtained from the foregoing operations may be subjected to a hydrophilizing treatment involving immersion in an aqueous solution of an alkali metal silicate.

The treatment conditions, while not subject to any particular limitation, are exemplified by immersion for 1 to 60 seconds in an aqueous solution having a concentration of from 0.01 to 5.0% at a temperature of from 5 to 40° C. Following immersion, the support is rinsed with running water. Preferred treatment conditions include an immersion temperature of from 10 to 40° C. and an immersion time of from 2 to 20 seconds.

Illustrative examples of alkali metal silicates that may be used in the invention include sodium silicate, potassium silicate and lithium silicate. Suitable amounts of hydroxides such as sodium hydroxide, potassium hydroxide or lithium hydroxide may be included in the aqueous alkali metal silicate solution.

An alkaline earth metal salt or a Group 4 (Group IVA) metal salt may also be included in the aqueous alkali metal silicate solution. Examples of suitable alkaline earth metal salts include nitrates such as calcium nitrate, strontium nitrate, magnesium nitrate and barium nitrate; and also sulfates, hydrochlorides, phosphates, acetates, oxalates, and borates. Exemplary Group 4 (Group IVA) metal salts include titanium tetrachloride, titanium trichloride, titanium potassium fluoride, titanium potassium oxalate, titanium sulfate, titanium tetraiodide, zirconyl chloride, zirconium oxide, zirconium oxychloride and zirconium tetrachloride. These alkaline earth metal salts and Group 4 (Group IVA) metal salts may be used singly or as combinations of two or more thereof.

A photosensitive film is provided on the lithographic printing plate support obtained as described above, then is subjected to imagewise exposure and development in a platemaking process, thereby completing the production of a photosensitive lithographic printing plate. Such photosensitive lithographic printing plates can be manufactured to a high quality owing to the improved surface quality of the continuous cast strip (aluminum alloy strip).

EXAMPLES

The present invention is illustrated more fully in the following examples, which are illustrative and should not be construed as limiting the invention.

Example 1

A continuous cast strip (aluminum alloy strip) 300 was produced using the continuous casting and rolling apparatus 1 shown in FIG. 1.

A melt 100 prepared in the melting and holding furnace 2 to a composition of 0.3% iron, 0.1% silicon and 0.01% copper, with the balance being inadvertent impurities and aluminum, was poured into a first launder 3. During passage of the melt 100 through the first launder 3, grain refiner wire (diameter, 10 mm) 200 composed of 5% titanium and 1% boron, with the balance being aluminum and inadvertent impurities, was added thereto, bringing the titanium and boron contents within the melt 100 to 0.015% and 0.003%, respectively.

Degassing treatment was carried out with a degasser (not shown) provided on the first launder 3, and filtration treatment was carried out with a filtering means 4. A ceramic foam filter (thickness, about 50 mm; mesh size, 30 ppi) was used as the filter 41.

After passing through a second launder 5, a liquid level controlling means 6 and a melt feed nozzle 7, the melt 100 advanced to a pair of cooled rolls 8,8, where it was rendered into a continuous cast strip (aluminum alloy strip) having a width of 670 to 2000 mm and a gauge of 5 mm. Here, by changing the width of the continuous cast strip (aluminum alloy strip) 300 to be formed, the time t it took for the melt 100 to pass through the second launder 5 was changed without altering the rotational speed of the cooled rolls 8,8, and a continuous cast strip (aluminum alloy strip) 300 was formed. The rotational speed of the cooled rolls 8,8 was about 1.85 m/min.

The second launder 5 had a width of 0.1 m and a depth of 0.30 m. As shown in Table 2, casting was carried out at four different melt depths D in the second launder 5.

To ensure that no $TiB_2$-containing melt residues remained in the second launder 5, casting was begun after first cleaning the interior of the launder with a vacuum cleaner. The temperature of the melt 100 at the start of casting was set to 730° C.

When 50 metric tons had been cast, the coil was rolled to a gauge of 2 mm, batch annealed at 550° C. for 5 hours, and finished to a gauge of 0.3 mm by finish rolling, following which the incidence of black streaks was examined. The incidence of black streaks was determined by surface treating the entire length of the coil, then visually inspecting 1000 sheets cut from the strip to a length of 800 mm. Determining the incidence of black streaks entailed examining the surface of the sheets obtained in the respective examples after first subjecting the surface to alkali etching treatment (amount of dissolution, 2 g/m$^2$), desmutting treatment (200 g of sulfuric acid/L, at 30° C.), hydrochloric acid dissolution treatment (amount of electricity furnished to anode reaction, 500 c/dm$^2$), alkali etching treatment (amount of dissolution, 0.2 g/m$^2$), desmutting treatment (200 g of sulfuric acid/L, at 30° C.), and anodizing treatment (weight of anodized layer, about 2 g/m$^2$).

The results are shown below in Table 1-1.

TABLE 1-1

Launder passage time and number of black streaks

| Passage time t (seconds) | Melt depth D (m) 0.1 | 0.15 | 0.2 | 0.25 |
|---|---|---|---|---|
| 30 | 3 | 10 | 20 | 38 |
| 40 | 0 | 5 | 12 | 19 |
| 50 | 0 | 0 | 3 | 15 |
| 60 | | 0 | 1 | 9 |
| 70 | | | 0 | 2 |
| 80 | | | 0 | 2 |
| 90 | | | | 0 |

The minimum launder passage times $t_{rain}$ determined from the following empirical formula based on the respective melt depths D are shown in Table 2.

$$t_{min}=270\times1.2\times D$$

TABLE 2

Minimum launder passage time $t_{min}$ obtained by empirical formula

| Melt depth D (m) | 0.1 | 0.15 | 0.20 | 0.25 |
|---|---|---|---|---|
| Passage time (s) | 32 | 49 | 65 | 81 |

As noted above, by setting the time t it takes for the aluminum melt 100 to pass through the second launder 5 to a value equal to or greater than the minimum launder passage time $t_{min}$ determined from the empirical formula, black streaks can be prevented from occurring.

Example 2

Next, the influences of the titanium and boron contents were investigated by carrying out casting at different titanium and boron contents in the melt 100.

Aside from changing the titanium and boron contents in the melt 100 following addition of the grain refiner wire (diameter, 10 mm) 200 to the three following sets of values, the same procedure was followed as in Example 1. The melt depth D in the second launder 5 was set to 0.15 m.

(Ti, B)=(0.06%, 0.012%)

(0.04%, 0.01%)

(0.025%, 0.005%)

The results are shown in Table 1-2 below.

TABLE 1-2

Launder passage time and number of black streaks

| | Ti content (%) | | | |
|---|---|---|---|---|
| | 0.06 | 0.04 | 0.025 | 0.015 |
| | B content (%) | | | |
| | 0.012 | 0.01 | 0.005 | 0.003 |
| Passage time t (seconds) | 0.1 | 0.15 | 0.2 | 0.25 |
| 30 | 52 | 33 | 19 | 10 |
| 40 | 21 | 15 | 9 | 5 |
| 50 | 0 | 0 | 0 | 0 |
| 60 | 0 | 0 | 0 | 0 |

As is apparent from the above results, at higher titanium and boron contents, when the launder passage time t is short, the incidence of black streaks rises. However, black streaks can be kept from arising by having the launder passage time t be longer than the minimum launder passage time $t_{min}$ determined by the above empirical formula. In the above example where (Ti, B)=(0.06%, 0.012%), the stability at the start of casting was poor; it took time to reach a state where casting could be stably carried out. This is because the titanium content in the present example is higher than the earlier stated titanium content desirable for increasing stability at the start of casting, which, as determined from formulas A to C below, is in a range of from 0.008 to 0.046% at a cast starting temperature of 730° C.

$$\{Ti\} \geqq 2\times10^{-6}\times(T-700)^2-3\times10^{-4}\times(T-700)+0.015 \quad \text{Formula A}$$

$$\{Ti\} \leqq 2\times10^{-5}\times(T-700)^2-2.4\times10^{-3}\times(T-700)+0.1 \quad \text{Formula B}$$

$$700 \leqq T \leqq 790 \quad \text{Formula C}$$

Here, {Ti} represents the titanium concentration (%) in the melt 100, and T is the temperature (° C.) of the melt 100 just prior to the melt feed nozzle 7.

Examples 3 to 10, Comparative Examples 1 to 8

Aside from changing the average flow velocity V (m/s) of the melt 100 in the second launder 5, the width (m) of the second launder 5, the melt depth D (m) in the second launder 5 and the length L of the second launder 5 in the manner shown in Table 3, the same procedure was carried out as in Example 1.

TABLE 3

| | Flow velocity V (m/sec) | Launder width (m) | Melt depth D (m) | Launder length L (m) | Formula (2) | Black streaks |
|---|---|---|---|---|---|---|
| EX 3 | 0.023 | 0.05 | 0.1 | 0.7 | satisfied | 0 |
| EX 4 | 0.035 | 0.05 | 0.1 | 1 | satisfied | 0 |

TABLE 3-continued

| | Flow velocity V (m/sec) | Launder width (m) | Melt depth D (m) | Launder length L (m) | Formula (2) | Black streaks |
|---|---|---|---|---|---|---|
| EX 5 | 0.046 | 0.05 | 0.1 | 1.3 | satisfied | 0 |
| EX 6 | 0.069 | 0.05 | 0.1 | 1.9 | satisfied | 0 |
| EX 7 | 0.012 | 0.05 | 0.2 | 0.7 | satisfied | 0 |
| EX 8 | 0.017 | 0.05 | 0.2 | 1 | satisfied | 0 |
| EX 9 | 0.023 | 0.05 | 0.2 | 1.3 | satisfied | 0 |
| EX 10 | 0.035 | 0.05 | 0.2 | 1.9 | satisfied | 0 |
| CE 1 | 0.023 | 0.05 | 0.1 | 0.5 | not satisfied | 8 |
| CE 2 | 0.035 | 0.05 | 0.1 | 0.8 | not satisfied | 5 |
| CE 3 | 0.046 | 0.05 | 0.1 | 1.1 | not satisfied | 5 |
| CE 4 | 0.069 | 0.05 | 0.1 | 1.7 | not satisfied | 4 |
| CE 5 | 0.012 | 0.05 | 0.2 | 0.5 | not satisfied | 5 |
| CE 6 | 0.017 | 0.05 | 0.2 | 0.8 | not satisfied | 3 |
| CE 7 | 0.023 | 0.05 | 0.2 | 1.1 | not satisfied | 3 |
| CE 8 | 0.035 | 0.05 | 0.2 | 1.7 | not satisfied | 2 |

Examples 11 to 13, Comparative Example 9

Next, an experiment was carried out to determine the upper limit in the length L of the second launder 5.

Based on the reasoning provided herein, a larger length L in the second launder 5 is desirable for preventing coarse $TiB_2$ particles which cause black streaks from being carried off downstream. However, if the length L of the second launder 5 is made too large, the temperature of the melt 100 as it passes through the second launder 5 may decrease, resulting in solidification of portions of the melt 100, which is unacceptable.

Hence, the examples of the invention and the comparative example were carried out while varying, of the conditions in Example 10, only the length L of the second launder 5, and the decrease in the temperature of the melt 100 when it passed through the second launder 5 was observed. The decrease in the temperature of the melt 100 was determined by comparing the temperature of the melt 100 passing through at the upstream end and the downstream end of the second launder 5. In the table, "no problem" indicates cases where the temperature decrease by the melt 100 was 30° C. or less. Cases where the temperature decrease was 40° C. or less were acceptable, but cases where the temperature decrease was more than 50° C. were not.

The results are shown in Table 4. Although not mentioned in the table, black streaks did not arise in any of Examples 11 to 13 or in Comparative Example 9. As expected, the black streak-preventing effects did not pose a problem so long as formula (2) was satisfied. However, when the length L of the second launder 5 is too large, the time t is takes for the melt 100 to pass through the second launder 5 becomes excessively long, as a result of which a temperature decrease which falls outside of the allowable range for the melt 100 can be seen to arise. Hence the upper limit in the length L of the second launder 5 was set to 4 m.

TABLE 4

| | Flow velocity V (m/s) | Launder width (m) | Melt depth D (m) | Launder length L (m) | Formula (2) | Temperature decrease | Passage time t |
|---|---|---|---|---|---|---|---|
| EX 11 | 0.035 | 0.05 | 0.2 | 2.5 | satisfied | no problem | 71 sec |
| EX 12 | 0.035 | 0.05 | 0.2 | 3.0 | satisfied | no problem | 86 sec |

TABLE 4-continued

| | Flow velocity V (m/s) | Launder width (m) | Melt depth D (m) | Launder length L (m) | Formula (2) | Temperature decrease | Passage time t |
|---|---|---|---|---|---|---|---|
| EX 13 | 0.035 | 0.05 | 0.2 | 4.0 | satisfied | temp. decrease in allowable range | 114 sec |
| CE 9 | 0.035 | 0.05 | 0.2 | 3.2 | not satisfied | temp. decrease outside allowable range, heating required | 129 sec |

Examples 14 to 20

Next, in the continuous casting and rolling apparatus 1 shown in FIG. 1, a trapping means was provided within the liquid level controlling means 6 and/or the melt feed nozzle 7, and the black streak-suppressing effects thereof were checked.

An aluminum melt 100 prepared in the melting and holding furnace 2 to a composition of 0.3% iron, 0.12% silicon and 0.005% copper, with the balance being inadvertent impurities and aluminum, was poured into the first launder 3. During passage of the melt 100 from the first launder 3, a grain refiner wire (diameter, 10 mm) 200 composed of 5% titanium and 1% boron, with the balance being aluminum and inadvertent impurities, was added thereto, bringing the titanium and boron contents in the melt 100 to 0.015% and 0.003%, respectively.

Degassing treatment was carried out with a degasser (not shown) provided on the first launder 3, and filtration treatment was carried out with a filtering means 4. A ceramic foam filter (thickness, about 50 mm; mesh size, 30 ppi) was used as the filter 41.

After passing through a second launder 5, a liquid level controlling means 6 and a melt feed nozzle 7, the melt 100 advanced to a pair of cooled rolls 8,8, where it was rendered into a continuous cast strip (aluminum alloy strip) 300 having a width of 2000 mm and a gauge of 5 mm. The rotational speed of the cooled rolls 8,8 was about 1.85 m/s.

The second launder 5 was given a width of 0.1 m, a melt depth D of 0.15 m, and a length L of 1.2 m. The flow velocity V of the melt passing through the second launder 5 was set to 0.023 m/s. These conditions satisfy formula (1) (t 49 seconds) and formula (2) (4 m≧L≧1.1 m).

In the liquid level controlling means 6, the height of the step 63 shown in FIG. 2 was set to 0 mm (no trapping means), 50 mm, or 100 mm.

In the melt feed nozzle 7, a dam-like trapping means having a height of 15 mm was provided in a portion of the nozzle having a channel height of 30 mm at 0 places (no trapping means), one place (as shown in FIG. 2) or -two places (as shown in FIG. 3).

The coil when 50 metric tons had been cast was rolled to 2 mm, batch annealed at 550° C. for 5 hours, and finished to a gauge of 0.3 mm by finish rolling, following which the presence or absence of black streaks was checked in the same way as described above. In cases where black streaks were not confirmed, the amount of strip cast was increased so as to determine the amount of casting carried out when a single black streak is found.

The results are shown in Table 6.

TABLE 5

| | Height of step 63 (mm) | Trapping means 71, 72 | After casting 50 metric tons of strip | Amount of casting at which black streak defects appeared |
|---|---|---|---|---|
| EX 14 | 0 | none | no black streaks | 100 metric tons |
| EX 15 | 10 | none | no black streaks | 100 metric tons |
| EX 16 | 50 | none | no black streaks | 180 metric tons |
| EX 17 | 100 | none | no black streaks | 190 metric tons |
| EX 18 | 100 | 1 place | no black streaks | 230 metric tons |
| EX 19 | 100 | 2 places | no black streaks | 250 metric tons |
| EX 20 | 0 | 1 place | no black streaks | 110 metric tons |

In Example 12 in which a trapping means was provided in neither the liquid level controlling means nor the melt feed nozzle 7, when the amount of strip that had been cast is relatively small (in the present example, 50 metric tons or less), black streaks can be prevented from occurring. However, when a continuous cast strip of 100 metric tons or more is manufactured, coarse $TiB_2$ particles which had settled to the bottom of the second launder 5, the liquid level controlling means 6 or the melt feed nozzle 7 were found to have been carried off downstream due to, for example, changes in the flow velocity of the melt, causing black streaks to occur. However, it was confirmed that, by providing a trapping means within the liquid level controlling means 6 and/or the melt feed nozzle 7, the appearance of black streaks can be suppressed when a continuous cast strip of 100 metric tons or more is produced.

Examples 21 and 22

Next, to ascertain the effects of combination with suitable filtering means as a way of further suppressing the formation of black streak, the filtering means used in Examples 17 and 18 (a ceramic foam filter having a thickness of about 50 mm and a mesh size of 30 ppi) was replaced with the filtering means mentioned in above-cited JP 3549080 B, i.e., a filtering means composed of a pre-filter chamber, a filter which blocks the passage of particles of compounds of titanium and boron having a particle size of 10 μm or more, and a post-filter chamber, wherein the pre-filter chamber, the filter and the post-filter chamber are heated with a heater. The filters used in these examples were ceramic tube filters (manufactured by TKR) obtained by sintering heat-resistant particles having a diameter of from 0.5 to 2.0 mm.

The results are shown in Table 6.

TABLE 7

| | Filtering means | Height of step 63 (mm) | Trapping means 71, 72 | After casting 50 metric tons of strip | Amount of casting at which black streaks appear |
|---|---|---|---|---|---|
| EX 18 | ceramic foam filter | 100 | none | no black streaks | 190 metric tons |
| EX 17 | ceramic foam filter | 100 | one | no black streaks | 230 metric tons |

TABLE 7-continued

| | Filtering means | Height of step 63 (mm) | Trapping means 71, 72 | After casting 50 metric tons of strip | Amount of casting at which black streaks appear |
|---|---|---|---|---|---|
| EX 21 | ceramic tube filter | 100 | none | no black streaks | 240 metric tons |
| EX 22 | ceramic tube filter | 100 | one | no black streaks | 300 metric tons |

As shown in Table 6, by using the filtering means mentioned in JP 3549080 B, the occurrence of black streaks during continuous casting was further suppressed. This is presumably due to a large decrease in the number of coarse $TiB_2$ particles that slip through the filtering means and travel downstream, reducing the amount of large $TiB_2$ particles which do not serve any useful purpose in casting and settle to the bottom of the second launder 5, and thus making it more difficult for black streaks to arise even during the continuous casting of 200 metric tons or more.

In each of the above examples and comparative examples, a cast strip having a gauge of 0.3 mm manufactured by the same procedure as in Example 1 from the coil when 50 tons had been cast was subjected to the following operations in the indicated order: alkali etching treatment (amount of dissolution, 2 g/m$^2$), desmutting treatment (200 g of sulfuric acid/L, at 30° C.), hydrochloric acid electrolytic treatment (amount of electricity furnished for the anode reaction, 500 c/dm$^2$), alkali etching treatment (amount of dissolution, 0.2 g/m$^2$), desmutting treatment (200 g of sulfuric acid/L, at 30° C.), and anodizing treatment (weight of anodized layer, about 2 g/m$^2$). The sample for surface examination obtained from the cast strip following surface treatment was subjected to surface analysis for titanium and boron with an electron probe microanalyzer (EPMA). The microanalyzer used was JXA-8800 manufactured by JEOL Ltd. Measurement was carried out at three places on each specimen at an acceleration voltage of 20 keV, over a measurement surface area of 8.5×8.5 mm, and at a resolution of 20 μm. The results confirmed for each example of the invention that the titanium particles which were lenticularly deformed in the rolling direction did not have widths in excess of 100 μm.

Example 23

Next, the effects of combinations with measures for preventing defects specific to continuous casting other than black streaks were examined.

Of the conditions in the above examples, continuous casting was carried out under the following conditions: height of step 63 in liquid level controlling means 6=100 mm, trapping means 71 provided at one place within melt feed nozzle 7, average flow velocity V of melt 100 in second launder 5=0.035 m/s, length L of second launder 5=2.5 m, width of second launder 5=0.05 m, melt depth D of second launder 5=0.2 m, passage time t of melt 100 in second launder 5=71 seconds (calculated value).

The melt 100 prepared in the melting and holding furnace 2 to a composition of 0.3% iron, 0.12% silicon and 0.005% copper, with the balance being inadvertent impurities and aluminum, was poured into the first launder 3. A grain refiner wire (diameter, 10 mm) 200 composed of 5% titanium and 1% boron, with the balance being aluminum and inadvertent impurities, was added to the melt 100 during passage through the first launder 3, thereby adjusting the titanium and boron contents in the melt 100 to 0.015% and 0.003%, respectively.

Degassing treatment was carried out with a degasser (not shown) provided on the first launder 3. Specifically, argon gas was blown into the melt 100 with a rotary type degasser so as to lower the hydrogen gas concentration within the melt 100 to 0.12 cc or less per 100 g of the melt.

A ceramic foam filter (thickness, 50 mm; mesh size, 30 ppi) was used as the filtering means 4.

The above conditions were employed as common conditions.

The other conditions are indicated below. Combinations of the respective conditions are shown in Table 8.

Experiments were carried out for two cases. In one case (Level A-1), a master alloy containing 99.7% new aluminum metal and various added elements was added together with aluminum scrap generated in house and of known composition to give the above-indicated composition. In an even more preferable second case (Level A-2) in which the amount of matrix alloy added is reduced and, to make effective use of materials, spent lithographic printing plates are added as a starting material, lithographic printing plates composed of 0.29% iron, 0.08% silicon, 0.015% copper, with the balance being aluminum and inadvertent impurities, were added to the starting material in a weight corresponding to 5% of the total weight of melt.

Following degassing treatment, the melt 100 advanced to the cooled rolls 8,8 via the filtering means 4, the second launder 5, the liquid level controlling means 6 and the melt feed nozzle 7, with delivery of the melt being carried out uniformly in the width direction so that the temperature difference of the melt 100 in the width direction at the melt feed nozzle 7 outlet was 30° C. or less. To make the temperature in the width direction uniform, a block which functions as a flow straightening plate was disposed within the melt feed nozzle 7, thereby rendering the flow uniform in the width direction and making it possible to set the temperature difference in the width direction to 30° C. or less. Experiments were carried out here for two cases: in one case (Level B-2), a flow straightening plate was not installed, and the temperature difference in the width direction at the outlet of the melt feed nozzle 7 did not satisfy the condition of 30° C. or less; in the other case (Level B-1), a flow straightening plate was installed, and the temperature difference in the width direction at the outlet of the melt feed nozzle 7 satisfied the condition of 30° C. or less.

The inside surface of the melt feed nozzle 7 must be given a poor wettability to the melt 100 so that the melt 100 does not readily stick thereto. To this end, the inside surface of the melt feed nozzle 7 was coated with a parting material containing aggregate particles having a particle size distribution with a median particle diameter of from 5 to 20 μm and a modal particle diameter of from 4 to 12 μm. Specifically, the inside surface of the nozzle 7 was coated with a parting material containing boron nitride BN as the aggregate. Experiments were carried out for both this case (Level C-1) and for a second case (Level C-2) in which the inside surface of the nozzle 7 was coated with a zinc oxide parting material having a median particle diameter of 3 μm and a modal particle diameter of 2 μm.

In addition, the cooled rolls 8,8 were coated on the surfaces thereof with a special-purpose parting material to prevent the melt 100 from sticking thereto. The parting material had an average particle size of from 0.7 to 1.5 μm and a median diameter of from 0.5 to 1.2 μm; less than 5% of all the particles were 0.2 μm or smaller, less than 10% of all the particles were 0.4 μm or smaller, less than 10% of all the particles were 2 μm or larger, and less than 5% of all the particles were 3 μm or larger. The above parting material was applied by spraying on a suspension of the carbon particles dispersed in water so that the amount of the parting material applied to the cooled rolls 8,8 was in a range of from 60 to 1200 mg/m$^2$ (Level D-1). Experiments were similarly carried out on, as examples outside the desirable range in the amount of parting material applied: a case in which the amount applied was set low at 50 mg/m$^2$ (Level D-2), and a case in which the amount applied was set high at 1300 mg/m$^2$ (Level D-3). In cases where parting material was not applied, the sticking of melt 100 to the cooled rolls 8,8 arose immediately after the start of casting, which made a clean casting startup impossible.

Setting the above-described weight of parting material that is applied onto the cooled rollers 8,8 within a stable range enables good results to be obtained. By monitoring the rolling load applied to the cooled rolls 8,8 and increasing the amount of parting material applied when the load increases, casting can be stabilized even further.

The circumferential velocity of the cooled rolls 8,8 is important for preventing the melt 100 from solidifying within the melt feed nozzle 7 before the melt 100 comes into contact with the cooled rolls 8,8. The lower limit in the circumferential velocity (m/min) was made to satisfy the formula $$V \geqq 5\times10^{-5}\times(D/t^2)$$

in accordance with the diameter of the cooled rolls 8,8 and the plate gauge. Here, because $5\times10^{-5}\times(D/t^2)=1.6$ m/min, V was set to 1.85 m/min. Experiments were carried out at this velocity V of 1.85 m/min (Level E-1), at a low velocity V=1.5 m/min (Level E-2), and at a high velocity V=2.0 m/min (Level E-3).

By setting the melt temperature so as to satisfy the following formulas at the start of casting, it was possible to stably begin casting.

$$\{Ti\} \geqq 2\times10^{-6}\times(T-700)^2-3\times10^{-4}\times(T-700)+0.015 \quad \text{Formula A}$$

$$\{Ti\} \leqq 2\times10^{-5}\times(T-700)^2-2.4\times10^{-3}\times(T-700)+0.1 \quad \text{Formula B}$$

$$700 \leqq T \leqq 790 \quad \text{Formula C}$$

Here, {Ti} represents the titanium concentration (%) in the melt 100, and T is the temperature (° C.) of the melt 100 just prior to the melt feed nozzle 7.

In the present example, T was 720° C. and the titanium content was 0.015%.

The continuous cast strip (aluminum alloy strip) is cooled by the cooled rolls 8,8. However, because excessive cooling is undesirable, the cooling temperature is preferably the recrystallization temperature of 280° C. or higher. In the present example, the cooling temperature was set to 320° C. This case is designated as Level F-1. In a separate case, cooling to below the recrystallization temperature was carried out by spraying a water mist at the outlet; this case is designated as Level F-2.

The completed continuous cast strip (aluminum alloy strip) is taken up as a coil and lowered to room temperature, after which it is cold-rolled to a strip gauge of from 1.5 to 3 mm. In the present example, the strip was rolled to a gauge of 2 mm.

Next, batch-type intermediate annealing was carried out in a temperature range of from 450 to 600° C. for 5 hours, after which a cold rolling step and a straightening step were carried out, thereby giving an aluminum alloy strip having a gauge of from 0.1 to 0.5 mm. The aluminum alloy strip for lithographic printing plates thus manufactured had a tensile strength of at least 150 N/mm$^2$, and had an offset yield strength of at least 100 N/mm$^2$ when heat-treated by being held for 7 minutes at a heating temperature of 300° C. The rate of temperature rise in batch annealing is preferably set to 10° C./sec or below.

In the present example, intermediate annealing was carried out at temperatures of 480° C., 510° C., 550° C. and 580° C. These respective cases are designated below as Levels G-1, G-2, G-3 and G-4. In addition, a case where intermediate annealing was carried out at a temperature of 400° C., which falls outside of the desirable temperature range, is designated below as Level G-5.

Intermediate annealing temperatures in excess of 600° C. were not used here because of undesirable discoloration at the coil surface and the high load on the annealing furnace. Batch annealing was carried out at a temperature rise rate of 8° C./sec. After annealing, the temperature was lowered to room temperature, following which finish cold rolling to a strip gauge of 0.3 mm was carried out. The resulting strip was tested to determine the tensile strength and to determine the offset yield strength following heat treatment by holding the strip for 7 minutes at a heating temperature of 300° C.

After the above finishing treatment, the strip flatness was corrected with a tension leveler, thereby giving a coil of aluminum alloy strip for lithographic printing plates.

Tables 7 and 8 below show combinations of the respective parameters (levels) indicated above.

TABLE 7

| | Test No. | | | | | | |
|---|---|---|---|---|---|---|---|
| | 1 | 2 | 3 | 4 | 5 | 6 | 7 |
| Passage time t | 71 sec | 71 sec | 71 sec | 71 sec | 71 sec | 71 sec | 71 sec |
| Launder length L | 2.5 m | 2.5 m | 2.5 m | 2.5 m | 2.5 m | 2.5 m | 2.5 m |
| Height of step 63 (mm) | 100 mm | 100 mm | 100 mm | 100 mm | 100 mm | 100 mm | 100 mm |
| Trapping means 71 | 1 place | 1 place | 1 place | 1 place | 1 place | 1 place | 1 place |
| Starting material | A-1 | A-2 | A-1 | A-1 | A-1 | A-1 | A-1 |
| Nozzle 7 outlet temperature | B-1 | B-1 | B-2 | B-1 | B-1 | B-1 | B-1 |
| Parting material within nozzle 7 | C-1 | C-1 | C-1 | C-2 | C-1 | C-1 | C-1 |
| Parting material on rolls 8 | D-1 | D-1 | D-1 | D-1 | D-2 | D-3 | D-1 |
| Circumferential velocity of rolls 8 | E-1 | E-1 | E-1 | E-1 | E-1 | E-1 | E-2 |
| Temperature after casting | F-1 | F-1 | F-1 | F-1 | F-1 | F-1 | F-1 |
| Intermediate annealing | G-3 | G-3 | G-3 | G-3 | G-3 | G-3 | G-3 |

TABLE 8

| | Test No. | | | | | |
|---|---|---|---|---|---|---|
| | 8 | 9 | 10 | 11 | 12 | 13 |
| Passage time t | 71 sec | 71 sec | 71 sec | 71 sec | 71 sec | 71 sec |
| Launder length L | 2.5 m | 2.5 m | 2.5 m | 2.5 m | 2.5 m | 2.5 m |
| Height of step 63 (mm) | 100 mm | 100 mm | 100 mm | 100 mm | 100 mm | 100 mm |
| Trapping means 71 | 1 place | 1 place | 1 place | 1 place | 1 place | 1 place |
| Starting material | A-1 | A-1 | A-1 | A-1 | A-1 | A-1 |
| Nozzle 7 outlet temperature | B-1 | B-1 | B-1 | B-1 | B-1 | B-1 |
| Parting material within nozzle 7 | C-1 | C-1 | C-1 | C-1 | C-1 | C-1 |
| Parting material on rolls 8 | D-1 | D-1 | D-1 | D-1 | D-1 | D-1 |
| Circumferential velocity of rolls 8 | E-3 | E-1 | E-1 | E-1 | E-1 | E-1 |
| Temperature after casting | F-1 | F-2 | F-1 | F-1 | F-1 | F-1 |
| Intermediate annealing | G-3 | G-3 | G-1 | G-2 | G-4 | G-5 |

For each combination of parameters (levels) indicated under the respective above test numbers, the appearance of the cast strip was evaluated for the coil when 10 metric tons had been cast and when 50 metric tons had been cast. Also, the appearance of the cast strip was examined after it had been rolled to a gauge of 2 mm, batch annealed under the various intermediate annealing conditions, finished to a gauge of 0.3 mm by finish annealing and surface treated. The incidence of black streaks was checked in the same way as in the earlier examples. That is, surface treatment was carried out on the entire length of the coil, following which 1,000 sheets cut from the strip to a length of 800 mm were visually inspected. To check for the occurrence of black streaks, the aluminum alloy sheets obtained in the respective examples were surface-treated under the following conditions: alkali etching (amount of dissolution, 2 g/m$^2$), desmutting (200 g of sulfuric acid/L, at 30° C.), hydrochloric acid dissolution (amount of electricity furnished to anode reaction, 500 g/dm$^2$), alkali etching (amount of dissolution, 0.2 g/m$^2$), desmutting (200 g of sulfuric acid/L at 30° C.) and anodization (weight of anodized layer, about 2 g/m$^2$), following which the surface of the sheet was examined. These set of conditions are referred to herein as "Surface Treatment Condition 1". The aluminum alloy sheets obtained in the respective examples were also surface-treated under another set of conditions: alkali etching (amount of dissolution, 3 g/m$^2$), desmutting (200 g of sulfuric acid/L, at 30° C.), nitric acid dissolution (amount of electricity furnished to anode reaction, 250 g/dm$^2$), alkali etching (amount of dissolution, 0.2 g/m$^2$), desmutting (200 g of sulfuric acid/L at 30° C.) and anodization (weight of anodized layer, about 2 g/m$^2$), following which the surface of the sheet was examined. This latter set of conditions are referred to herein as "Surface Treatment Condition 2".

Table 9 shows the results obtained for the various samples subjected to surface treatment under Surface Treatment Conditions 1 and 2 when the appearance of the sheets was checked at the cast strip stage prior to surface treatment and when the appearance of the sheets was checked following surface treatment. Evaluation of the appearance following surface treatment was carried out for the presence or absence of black streaks and other streaks ("other streak" refers collectively to streak-like defects other than black streaks), and for the uniformity of the grained shape (referred to below as "graining"). Aside from black streaks, examinations for other defects were carried out on three sheets of each type of surface-treated product by visual examination and using a scanning electron microscope (JSM 5500, manufactured by JEOL Ltd.). SEM examination was carried out at magnifications of 750×, 2,000× and 10,000×. The uniformity of graining was rated on a scale of 1 (poor) to 4 (good), with a rating of 2 or higher being acceptable. The appearance (other streaks) following surface treatment was rated on a scale of 1 (poor) to 9 (good), with a rating of 5 or higher being acceptable. The appearance of the cast sheet was rated on a scale of 1 (poor) to 3 (good), with a rating of 2 or higher being acceptable.

Of the various samples, in Test No. 8, the cast strip did not stabilize. Although it was possible to sample the coil when 10 metric tons had been cast, casting was subsequently stopped due to re-melting. As a result, it was impossible to collect samples when 50 metric tons had been cast.

TABLE 9

| | | After casting 10 metric tons | | | | After casting 50 metric tons | | | |
|---|---|---|---|---|---|---|---|---|---|
| Test No. | Surface treatment Condition | Cast strip (rating) | Black streaks (number) | Other streaks (rating) | Graining (rating) | Cast strip (rating) | Black streaks (number) | Other streaks (rating) | Graining (rating) |
| 1 | 1 | 3 | 0 | 9 | 4 | 3 | 0 | 9 | 4 |
| 1 | 2 | 3 | 0 | 9 | 4 | 3 | 0 | 9 | 4 |
| 2 | 1 | 3 | 0 | 9 | 4 | 3 | 0 | 9 | 4 |
| 2 | 2 | 3 | 0 | 9 | 4 | 3 | 0 | 9 | 4 |
| 3 | 1 | 2 | 0 | 8 | 4 | 2 | 0 | 7 | 4 |
| 3 | 2 | 2 | 0 | 7 | 4 | 2 | 0 | 6 | 4 |
| 4 | 1 | 3 | 0 | 8 | 4 | 3 | 0 | 8 | 4 |
| 4 | 2 | 3 | 0 | 6 | 4 | 3 | 0 | 6 | 4 |
| 5 | 1 | 2 | 0 | 5 | 3 | 2 | 0 | 5 | 3 |
| 5 | 2 | 2 | 0 | 5 | 3 | 2 | 0 | 5 | 3 |
| 6 | 1 | 2 | 0 | 5 | 3 | 2 | 0 | 5 | 3 |
| 6 | 2 | 2 | 0 | 5 | 3 | 2 | 0 | 5 | 3 |
| 7 | 1 | 3 | 0 | 9 | 4 | 2 | 0 | 5 | 4 |
| 7 | 2 | 3 | 0 | 9 | 4 | 2 | 0 | 5 | 4 |
| 8 | 1 | 2 | 0 | 6 | 3 | — | — | — | — |
| 8 | 2 | 2 | 0 | 6 | 3 | — | — | — | — |
| 9 | 1 | 2 | 0 | 7 | 4 | 2 | 0 | 7 | 4 |
| 9 | 2 | 2 | 0 | 7 | 4 | 2 | 0 | 7 | 4 |
| 10 | 1 | 3 | 0 | 8 | 3 | 3 | 0 | 8 | 3 |

TABLE 9-continued

| Test No. | Surface treatment Condition | After casting 10 metric tons | | | | After casting 50 metric tons | | | |
|---|---|---|---|---|---|---|---|---|---|
| | | Cast strip (rating) | Black streaks (number) | Other streaks (rating) | Graining (rating) | Cast strip (rating) | Black streaks (number) | Other streaks (rating) | Graining (rating) |
| 10 | 2 | 3 | 0 | 8 | 3 | 3 | 0 | 8 | 3 |
| 11 | 1 | 3 | 0 | 9 | 4 | 3 | 0 | 9 | 4 |
| 11 | 2 | 3 | 0 | 8 | 3 | 3 | 0 | 8 | 3 |
| 12 | 1 | 3 | 0 | 9 | 4 | 3 | 0 | 9 | 4 |
| 12 | 2 | 3 | 0 | 9 | 4 | 3 | 0 | 9 | 4 |
| 13 | 1 | 3 | 0 | 8 | 3 | 3 | 0 | 8 | 3 |
| 13 | 2 | 3 | 0 | 7 | 2 | 3 | 0 | 7 | 2 |

The above results confirm that, by combining the inventive method with other techniques for improving the appearance of continuous cast product and techniques for improving the grained shape, good lithographic printing plate supports can be obtained and that, even when the inventive method is used in combination with such techniques, black streaks can also be prevented from occurring.

In Test No. 2, although 5% of spent lithographic printing plate was added to the starting material, the results were confirmed to be entirely acceptable.

In Test No. 3, the temperature uniformity at the melt feed nozzle 7 outlet was lowered. The uniformity of the cast strip appearance decreased in the width direction. When rolling and surface treatment were carried out, streak-like non-uniformities in appearance arose, resulting in a decline in the rating for "other streaks."

In Test No. 4, the parting material coated on the inside surface of the melt feed nozzle 7 was a zinc oxide-based parting material which did not contain aggregate particles in the desirable range of the present invention. Conspicuous streaks arose in portions of the width direction, resulting in a lower rating for "other streaks." This condition was not identifiable in the cast strip, but became apparent when rolling and surface treatment were carried out. This presumably arose from the partial sticking of the melt 100 within the melt feed nozzle 7, which disrupted the flow of the melt 100, leading to solidification non-uniformities. The streaks were analyzed with an electron probe microanalyzer, as a result of which areas of iron and silicon segregation and streaks were marked and mechanical polishing and HF etching were carried out, following which the crystal microstructure was examined under a polarized light microscope. The crystal microstructure was confirmed to be non-uniform.

In Test No. 5. the amount of parting material coated onto the surface of the cooled rolls 8,8 was very small, whereas in Test No. 6, the amount of parting material coated on the surface of cooled rolls 8,8 was very large. In the former case, burr-like marks arose on the surface of the cast strip. After rolling and surface treatment had been carried out, these areas gave rise to streak-like defects, lowering the rating for "other streaks." In the latter case (Test No. 6), areas thickly coated with the parting material formed on the surface of the cast strip. After rolling and surface treated had been carried out, these areas similarly gave rise to the appearance of streak-like defects, lowering the rating for "other streaks." When the streaks which appeared following rolling and surface treatment were analyzed by the same technique as described above, iron was locally detected in the streaks on the former specimen (Test No. 5) and the crystal microstructure was observed to become finer around the streaks. This is presumably because the cooled rolls 8,8 made of iron stuck to the cast strip 300 in places, resulting in material transfer to the cast strip 300, and also because, owing to too little parting material, the cast strip underwent rapid cooling in places, resulting in a crystal microstructure that was too fine. As for the streaks on the latter specimen (Test No. 6), the crystal microstructure was coarser in surrounding areas. This is presumably because, owing to the application of too much parting material, localized heat transfer with the cooled rolls 8,8 decreased, resulting in gradual cooling and thus the formation of larger crystals.

Tests No. 7 and 8 represent cases in which the circumferential velocity of the cooled rolls 8,8 was small (Test No. 7) or large (Test No. 8). In the former case (Test No. 7), the initial period of casting (corresponding to the time up until 10 metric tons had been cast) posed no problem whatsoever. However, at some later point during casting, solidification of the melt 100 occurred within the melt feed nozzle 7, as a result of which the crystals in the cast strip 300 become extremely non-uniform. This state was confirmed as a striped pattern in the appearance of the cast strip 300, which pattern was especially striking when the cast strip 300 was microetched with Tucker's solution. This defect, known as "tiger marks," is a fatal appearance defect which arises due to movement of the solidification point upstream (to the melt feed nozzle 7) during casting when the circumferential velocity of the cooled rolls 8,8 is slow. Because the rolled strip itself had a coarse crystal structure, very strong streak-like defects arose, lowering the "other streak" rating.

In the latter case in which the velocity was large (Test No. 8), the cooling ability of the cooled rolls 8,8 was insufficient, resulting in a poor casting stability.

In Test No. 9, cooling subsequent to casting was intensified, which apparently caused the crystal grains in the cast strip 300 to become non-uniform and also caused the crystal microstructure after cooling and surface treatment to become non-uniform. The result was a lower "other streak" rating. On marking the streak areas and examining the crystal microstructure, it was found that the streaks contained both crystals that were larger than in surrounding areas and also crystals that were finer than in surrounding areas.

In Tests No. 10 to 13, different intermediate annealing temperatures were used. In Test No. 13, in which the annealing temperature was low, the electrolytically grained shape was non-uniform. This was presumably because of the low amount of silicon in solid solution within the aluminum alloy. The streak appearance tended to be somewhat diminished owing to the lack of uniformity in the grained shape.

Next, to ascertain the effects of the annealing temperature other than on the grained shape, the mechanical strength of the cast sheet (tensile strength, 0.2% offset yield strength after 7 minutes of heating at 300° C.) was rated for the test numbers shown in Table 10 below. The results are given in Table 10.

TABLE 10

| Test No. | 1 | 10 | 11 | 12 | 13 |
|---|---|---|---|---|---|
| Tensile strength ($N/mm^2$) | 155 | 156 | 153 | 155 | 150 |
| 0.2% Offset yield strength after 7 minutes of heating at 300° C. ($N/mm^2$) | 110 | 101 | 102 | 112 | 95 |

As is apparent from the above, there was substantially no change in the tensile strength. However, in the tests representing preferred embodiments of the invention (Tests No. 1, 10, 11, and 12), the cast sheet had a high 0.2% offset yield strength after 7 minutes of heating at 300° C. A high 0.2% offset yield strength after 7 minutes of heating at 300° C. indicates that the lithographic printing plate supports were resistant to a decline in strength when subjected to burning treatment to increase the press life of the lithographic printing plate following exposure, and were thus of high quality.

What is claimed is:

1. A method of manufacturing, by a continuous casting process, aluminum alloy strip for use in the production of supports for lithographic printing plates, comprising the step of passing an aluminum melt successively through a filtering means for filtering, a launder connected to the filtering means, a liquid level controlling means for controlling a liquid level, connected to the launder, and a melt feed nozzle connected to the liquid level controlling means, wherein the aluminum melt is obtained by melting an aluminum starting material, then adding to and melting in the molten aluminum starting material a titanium and boron-containing aluminum alloy, and the time t in seconds required for the aluminum melt to pass through the launder satisfies the following condition (1):

$$t \geqq 270 \times 1.2 \times D \quad (1),$$

where D is the depth in meters of the melt in the launder.

* * * * *